US008519897B2

(12) United States Patent
Duzdar et al.

(10) Patent No.: US 8,519,897 B2
(45) Date of Patent: Aug. 27, 2013

(54) LOW-PROFILE ANTENNA ASSEMBLY

(75) Inventors: Ayman Duzdar, Grand Blanc, MI (US); Gary Keith Reed, Grand Blanc, MI (US); Thomas Arthur Shirley, Chesaning, MI (US); David Allen Swartwood, Swartz Creek, MI (US)

(73) Assignee: Laird Technologies, Inc., Earth City, MO (US)

( * ) Notice: Subject to any disclaimer, the term of this patent is extended or adjusted under 35 U.S.C. 154(b) by 335 days.

(21) Appl. No.: 12/895,379

(22) Filed: Sep. 30, 2010

(65) Prior Publication Data

US 2012/0081253 A1 Apr. 5, 2012

(51) Int. Cl.
*H01Q 1/32* (2006.01)

(52) U.S. Cl.
USPC ..... 343/713; 343/711; 343/715; 343/787; 343/874

(58) Field of Classification Search
None
See application file for complete search history.

(56) References Cited

U.S. PATENT DOCUMENTS

| | | | | |
|---|---|---|---|---|
| 7,034,758 | B2 | 4/2006 | Haidacher et al. | |
| 7,239,281 | B2 | 7/2007 | Lu | |
| 7,295,167 | B2 | 11/2007 | Aminzadeh et al. | |
| 7,304,614 | B2 | 12/2007 | Silva | |
| 7,333,065 | B2 * | 2/2008 | Lindackers et al. | 343/713 |
| 7,429,958 | B2 | 9/2008 | Lindackers et al. | |
| 7,489,280 | B2 | 2/2009 | Aminzadeh et al. | |
| 7,492,318 | B2 * | 2/2009 | Duzdar et al. | 343/713 |
| 7,492,319 | B2 | 2/2009 | Lindackers et al. | |
| D591,271 | S | 4/2009 | Lindackers et al. | |
| 7,633,452 | B2 | 12/2009 | Noro et al. | |
| 7,755,551 | B2 | 7/2010 | Lindackers et al. | |
| 8,081,126 | B2 | 12/2011 | Ikeda et al. | |
| 2005/0062658 | A1 | 3/2005 | Magg et al. | |
| 2005/0219131 | A1 | 10/2005 | Haidacher et al. | |
| 2006/0220970 | A1 | 10/2006 | Aminzadeh et al. | |
| 2008/0111752 | A1 * | 5/2008 | Lindackers et al. | 343/713 |
| 2008/0198077 | A1 * | 8/2008 | Duzdar et al. | 343/715 |
| 2010/0013724 | A1 | 1/2010 | Ohshima et al. | |
| 2010/0136936 | A1 | 6/2010 | Jiang | |
| 2010/0277379 | A1 | 11/2010 | Lindackers et al. | |
| 2011/0221640 | A1 | 9/2011 | Huber | |
| 2012/0001811 | A1 | 1/2012 | Yoo et al. | |

FOREIGN PATENT DOCUMENTS

CN 101217213 7/2008

(Continued)

OTHER PUBLICATIONS

Photos of Antenna Products Ordered Jun. 2010; 6 pages.

(Continued)

*Primary Examiner* — Trinh Dinh
(74) *Attorney, Agent, or Firm* — Harness, Dickey & Pierce, P.L.C.

(57) ABSTRACT

A low-profile antenna assembly includes at least two antennas co-located under a cover. At least one of the at least two antennas includes an antenna configured for use with AM/FM radio. And, at least one of the at least two antennas includes an antenna configured for use with at least one or more of SDARS, GPS, cell phones, Wi-Fi, DAB-VHF-III, DAB-L, etc.

25 Claims, 21 Drawing Sheets

(56) References Cited

FOREIGN PATENT DOCUMENTS

| | | |
|---|---|---|
| CN | 300827936 | 9/2008 |
| KR | 10-0843150 | 7/2008 |
| WO | WO 2009/065806 | 5/2009 |
| WO | WO 2010/036435 | 4/2010 |
| WO | WO 2010/055051 | 5/2010 |
| WO | WO 2010/107258 | 9/2010 |
| WO | WO2011/051454 | 5/2011 |
| WO | WO 2012/044968 | 4/2012 |

OTHER PUBLICATIONS

International Search Report from PCT/US2009/049704 (which is not related through a priority claim, but has one of the same inventors) dated Dec. 3, 2009, 2 pages.

International Search Report and Written Opinion dated Mar. 21, 2012 from PCT/US2011/054280 (published as WO 2012/044968) which claims priority to the instant application; 9 pages.

* cited by examiner

LOW-PROFILE ANTENNA ASSEMBLY

FIELD

The present disclosure generally relates to antenna assemblies, and more particularly to low-profile antenna assemblies suitable for use with mobile platforms such as, for example, automobiles, etc. where the antenna assemblies are mountable to roofs, hoods, trunks, etc. of the automobiles.

BACKGROUND

This section provides background information related to the present disclosure which is not necessarily prior art.

Various different types of antennas are used in the automotive industry, including AM/FM radio antennas, satellite digital audio radio service antenna, global positioning system antennas, cell phone antennas, etc. Such antennas are commonly placed on roofs, hoods, or trunks of automobiles to help ensure that the antennas have unobstructed views overhead or toward the zenith.

SUMMARY

This section provides a general summary of the disclosure, and is not a comprehensive disclosure of its full scope or all of its features.

Example embodiments of the present disclosure are generally directed toward antenna assemblies suitable for use with mobile platforms. In one example embodiment, an antenna assembly generally includes a chassis configured to be mounted on a mobile platform, a first antenna coupled to the chassis and configured for use with AM/FM radio, and a second antenna coupled to the chassis and configured for use with at least one or more of cell phones, satellite digital audio radio services, global positioning systems, Wi-Fi, Wi-Max, and digital audio broadcasting. The first antenna includes first and second end flanges and a web positioned generally between the first and second end flanges such that the first antenna defines a generally English-language capital letter H shape (e.g., when viewed from above, etc.). The first antenna also includes electrical conductors extending between the first and second end flanges. As such, the web of the first antenna generally defines a capacitively loaded portion of the first antenna and the electrical conductors generally define an inductively loaded portion of the first antenna. In addition, the first antenna has a height of about 55 millimeters or less and defines a footprint having a length of about 65 millimeters or less and a width of about 30 millimeters or less.

Example embodiments of the present disclosure are also generally directed toward low-profile antenna assemblies suitable for use with mobile platforms. In one example embodiment, an antenna assembly generally includes a chassis and at least two antennas co-located on the chassis. At least one of the at least two antennas located on the chassis includes an antenna operable at one or more frequencies ranging between about 140 kilohertz and about 110 megahertz. The antenna assembly has a height of about 60 millimeters or less.

Example embodiments of the present disclosure are also generally directed toward antennas configured for use with AM/FM radio. In one example embodiment, an antenna configured for use with AM/FM radio generally includes a first end flange, a second end flange spaced apart from the first end flange, a web positioned generally between the first end flange and the second end flange, and electrical conductors extending between the first end flange and the second end flange. The web extends between the first end flange and the second end flange and is oriented generally perpendicular to the first end flange and the second end flange. At least one of the electrical conductors is located toward a first side surface of the web and at least one of the electrical conductors is located toward a second side surface of the web.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 4 is a forward perspective view of the antenna assembly of

Figure 2:
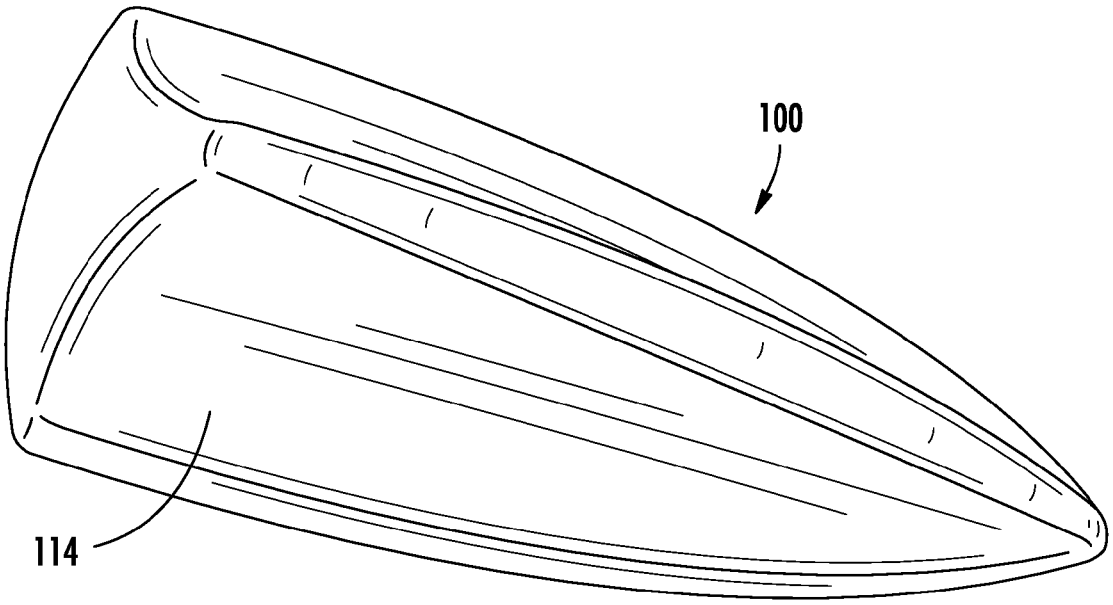
FIG. 2 is a perspective view of the antenna assembly of FIG. 1 shown removed from the car.
Figure 4:
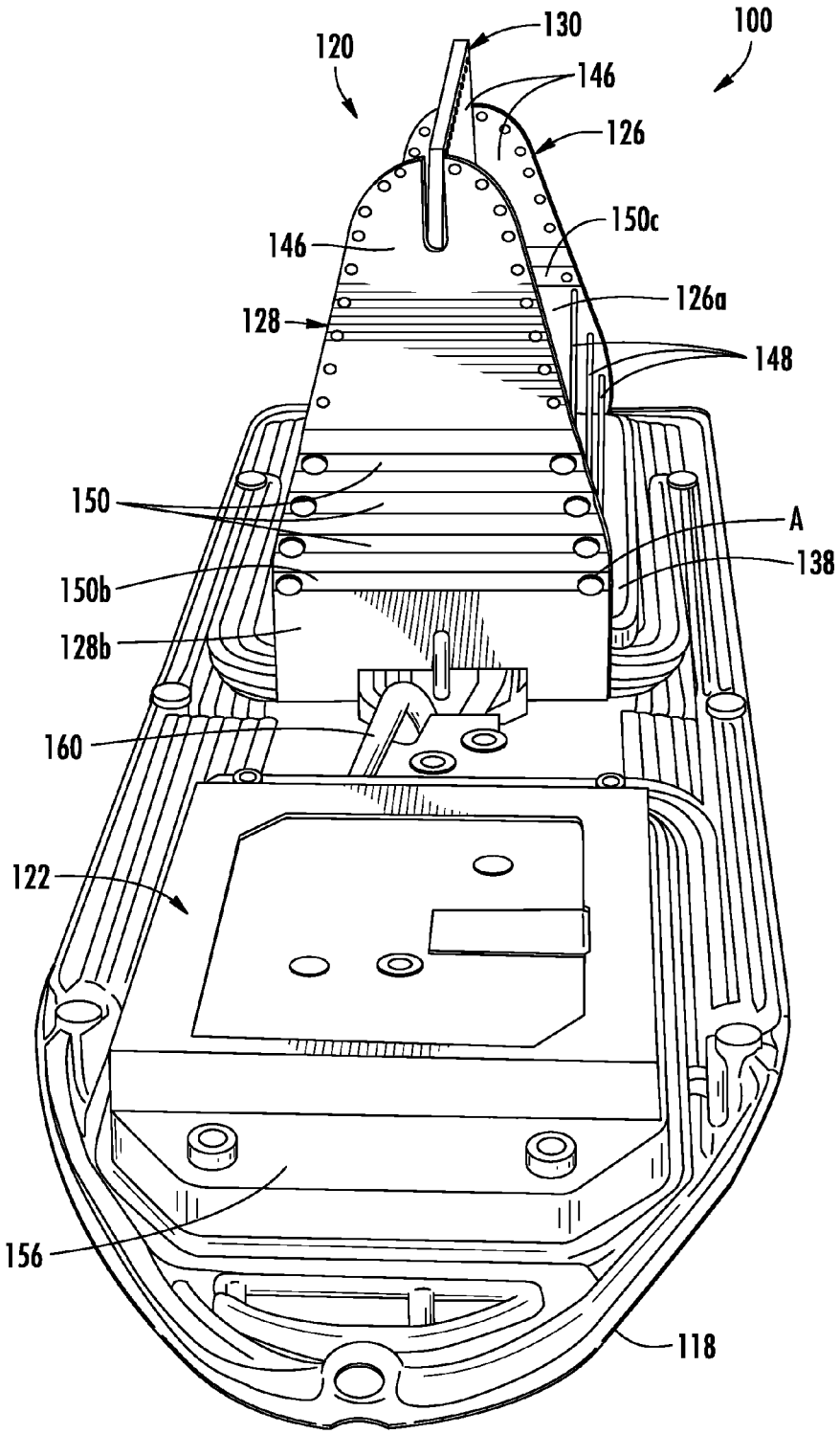
Figure 5:
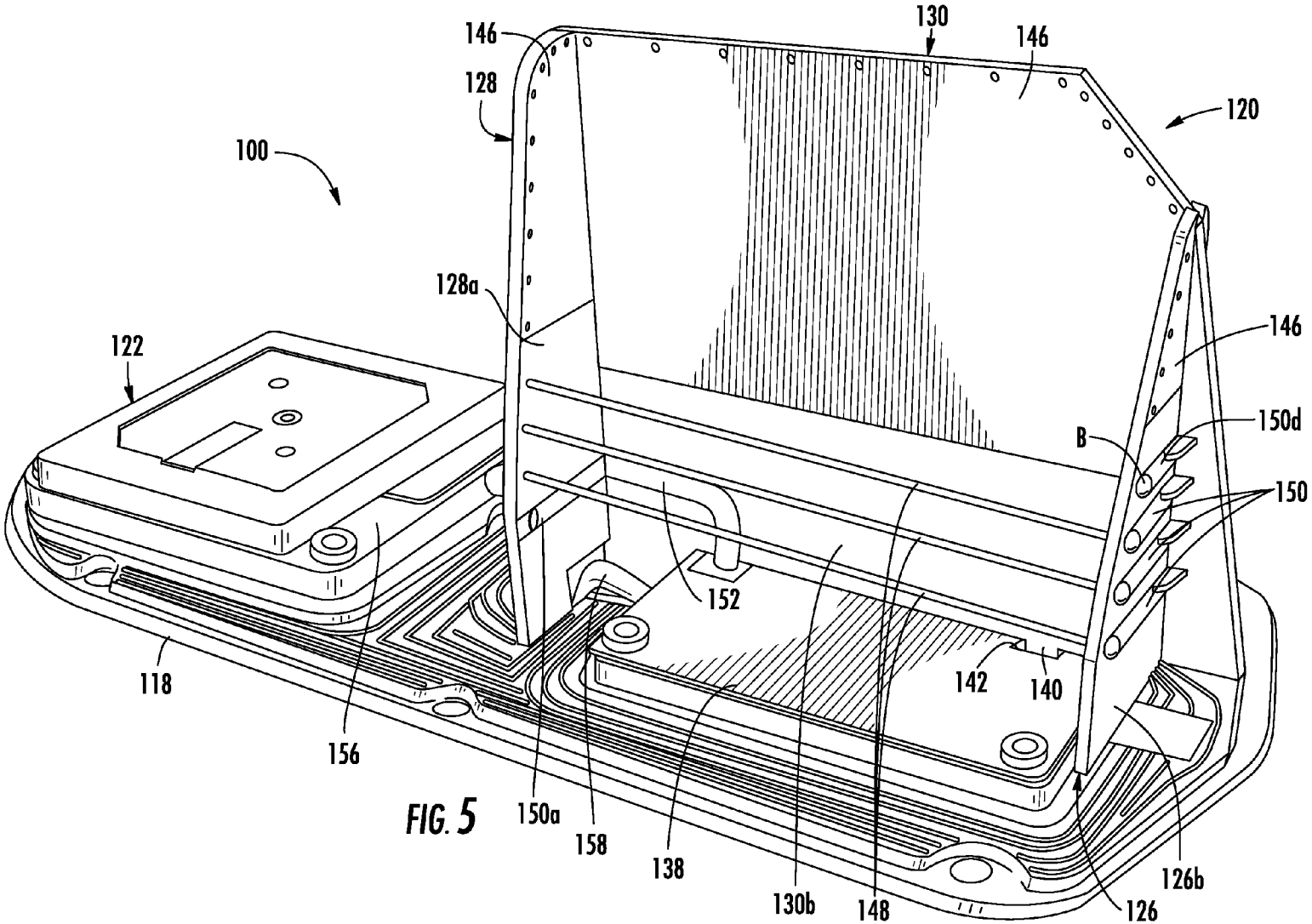
Figure 6:
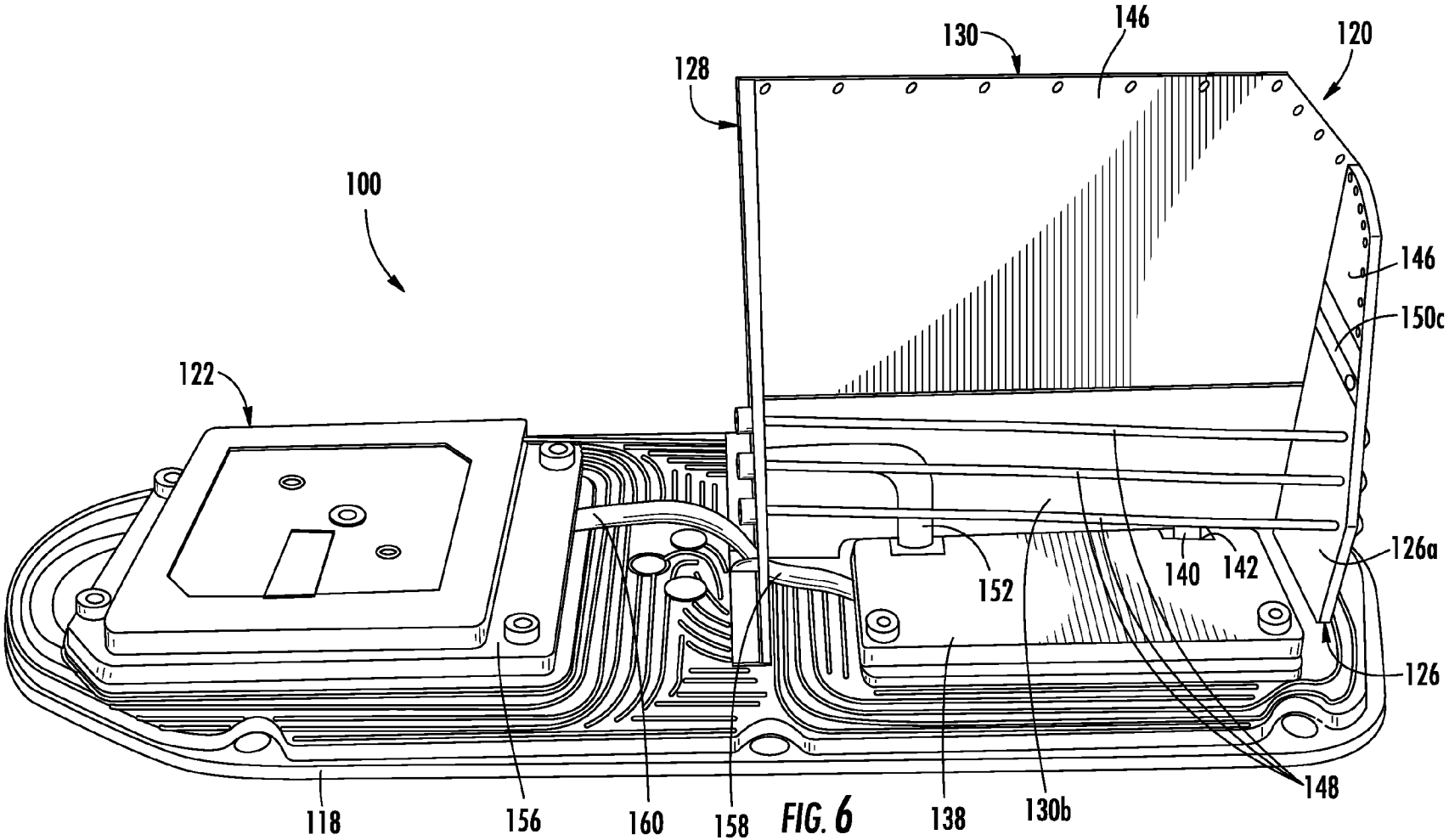
Figure 7:
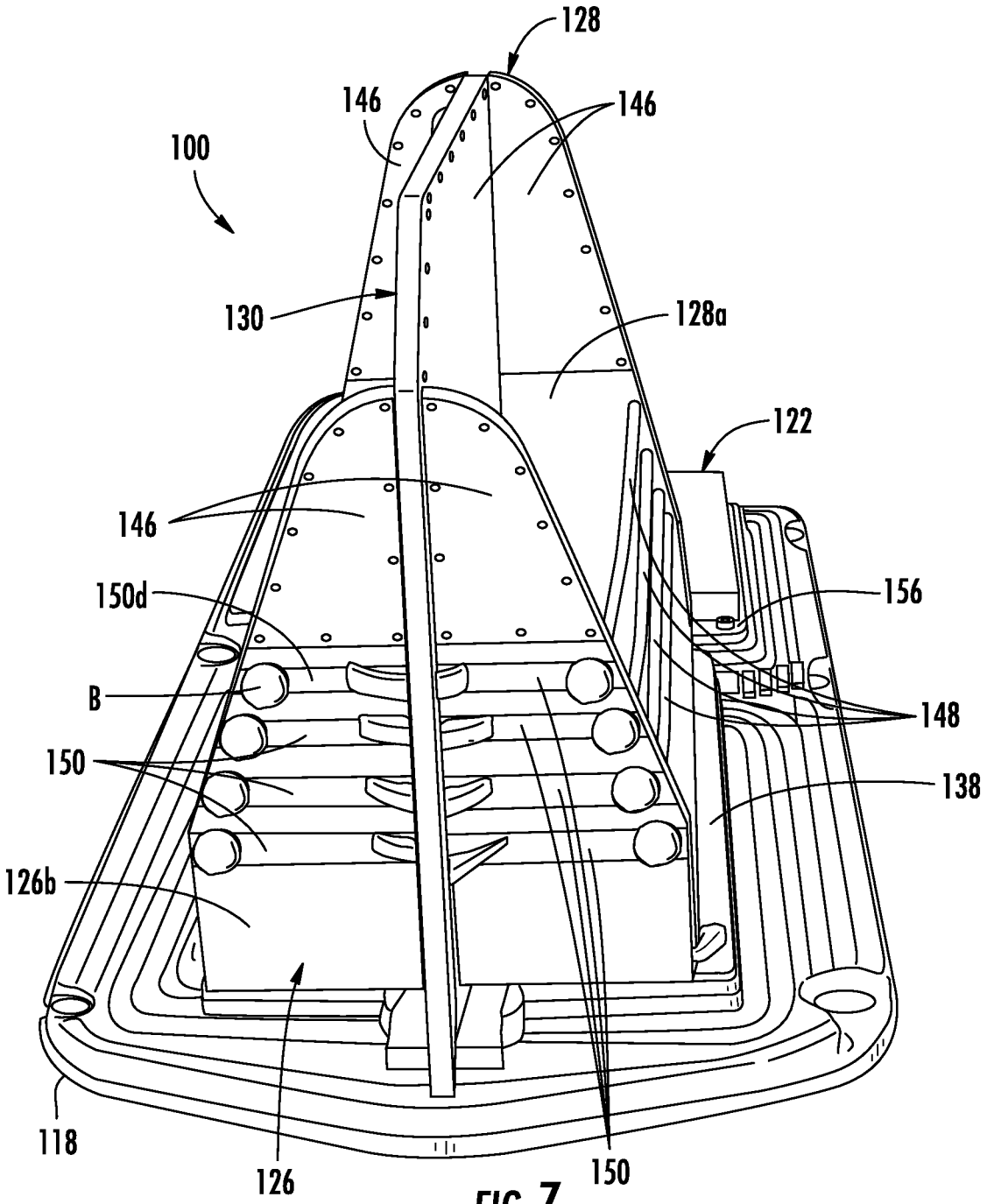
Figure 8:
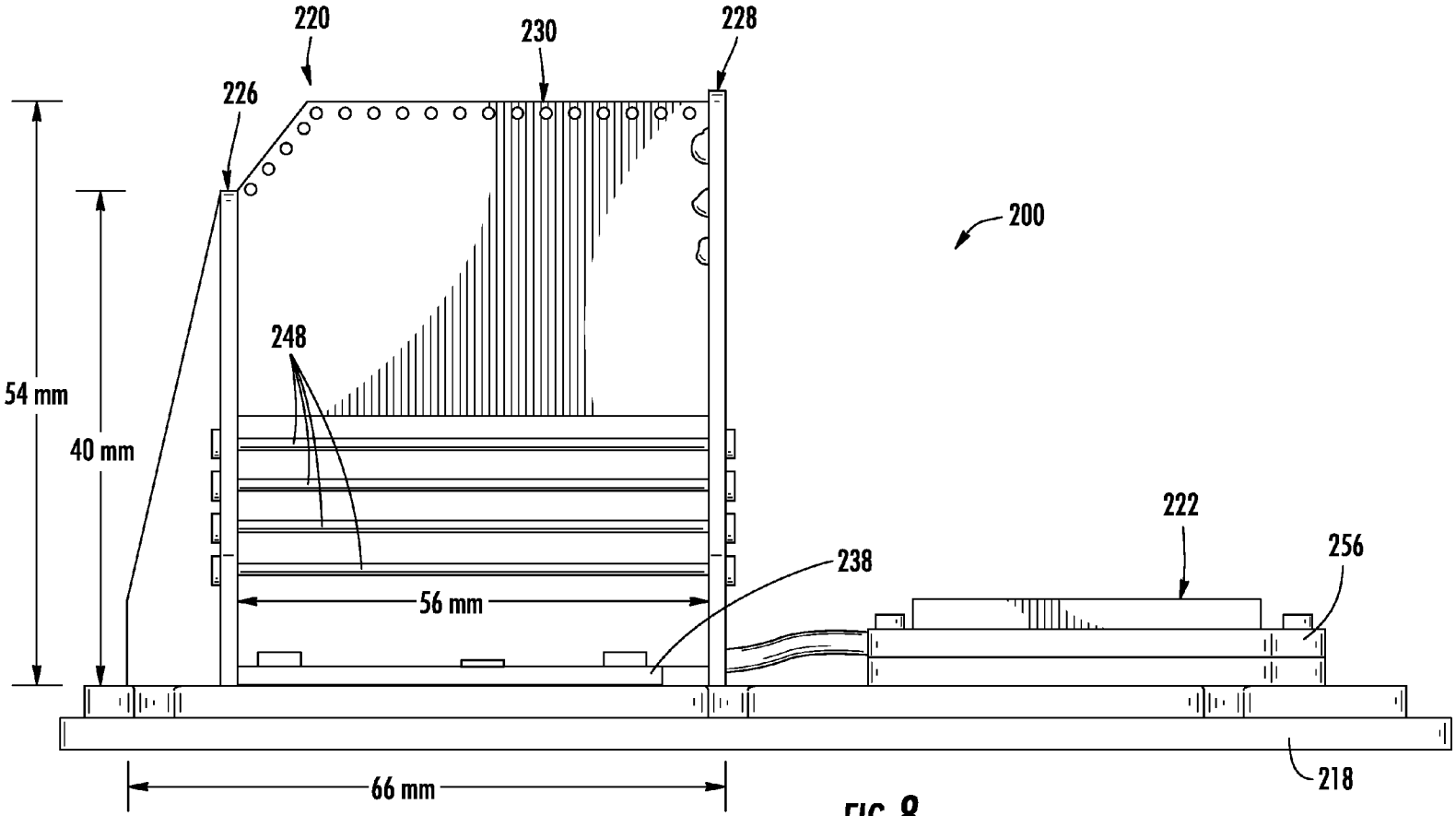
Figure 9:
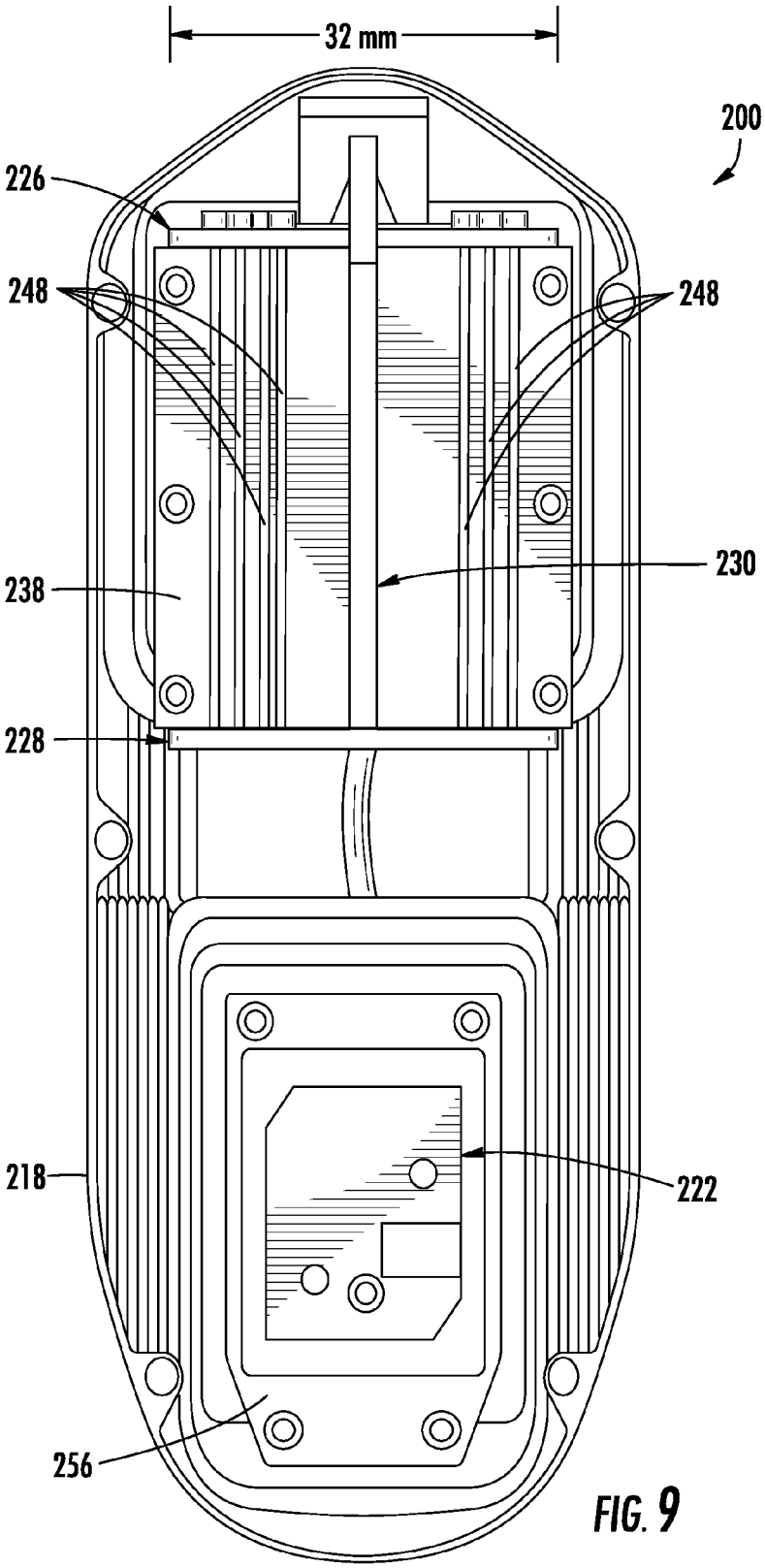
Figure 10:
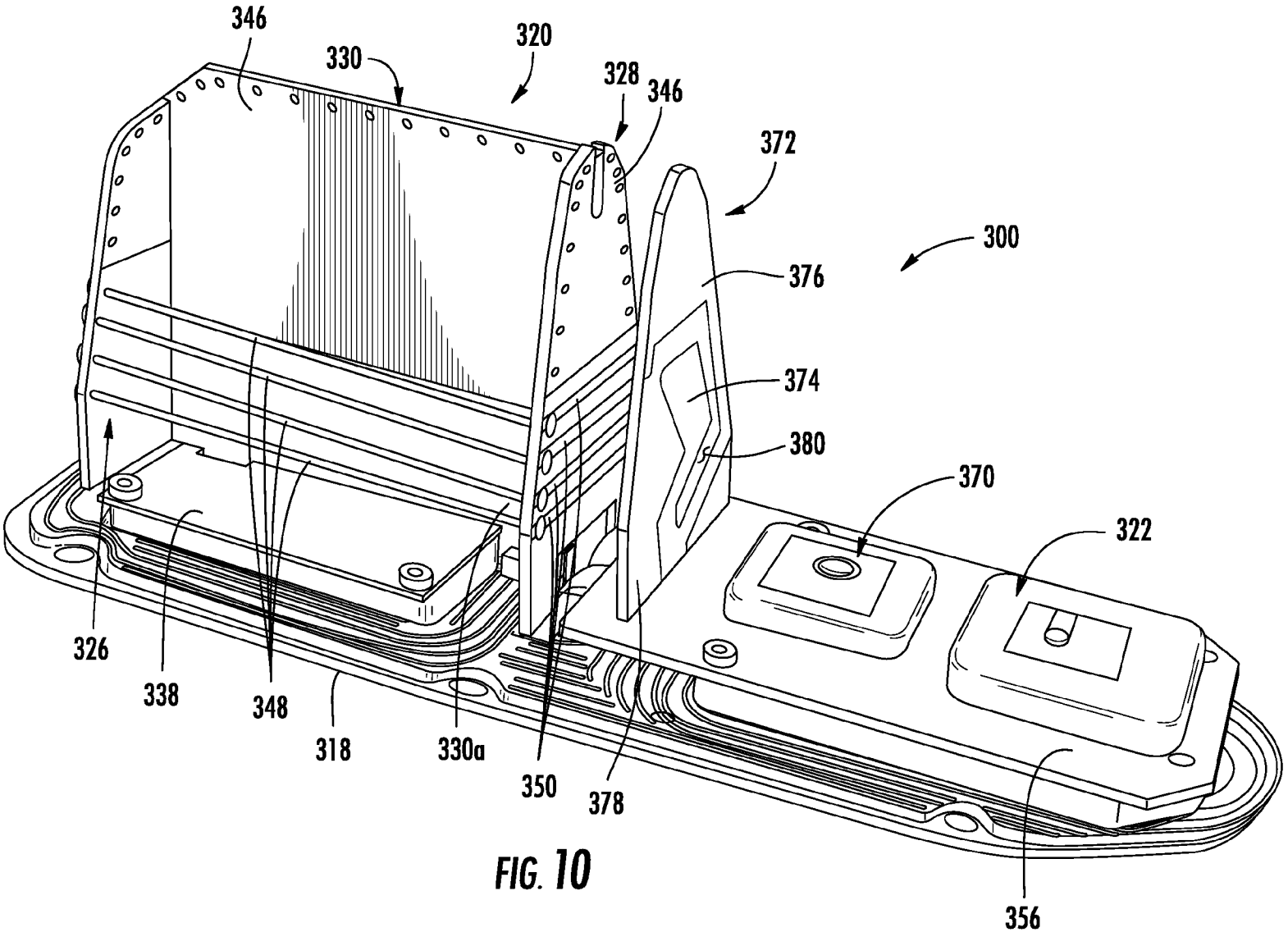
Figure 11:
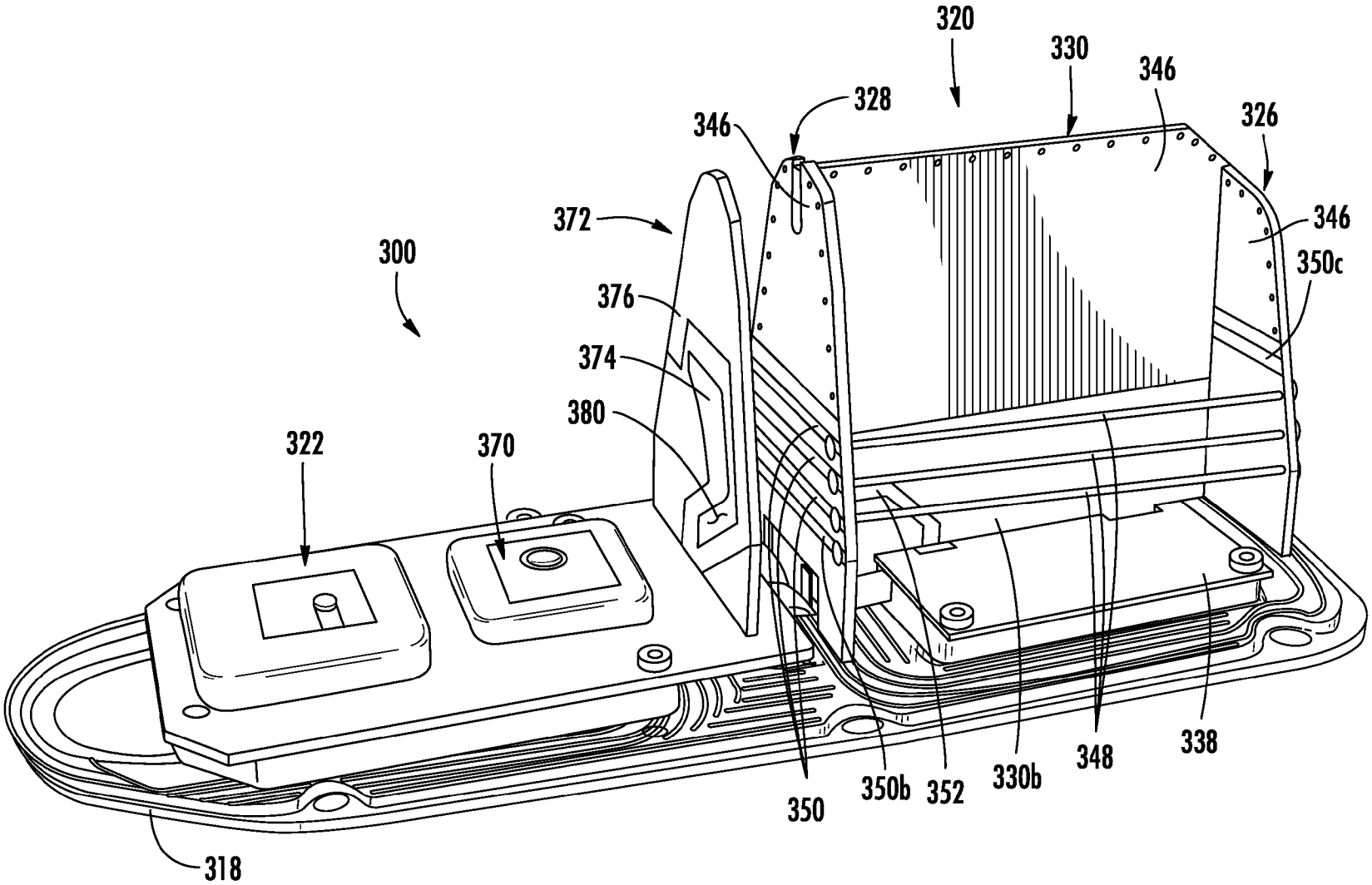
Figure 12:
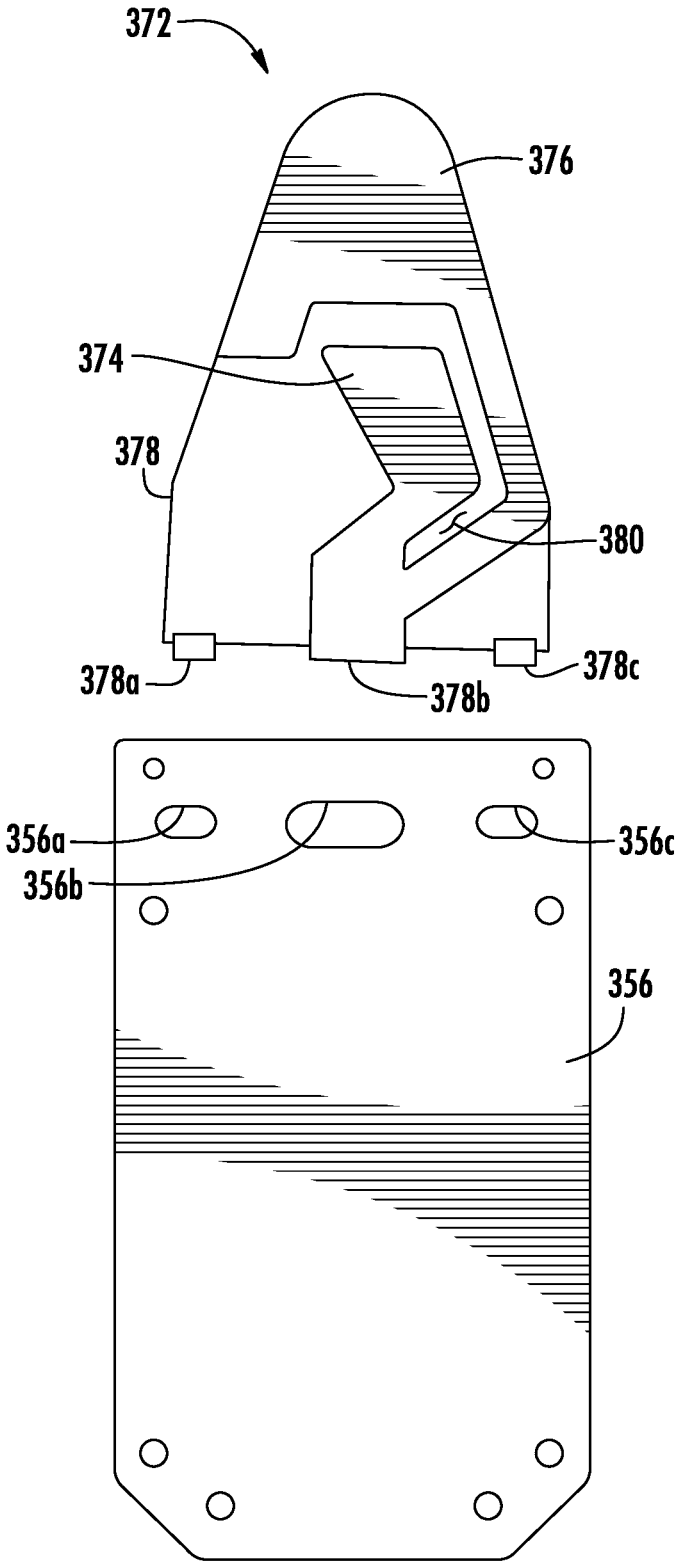
Figure 13:
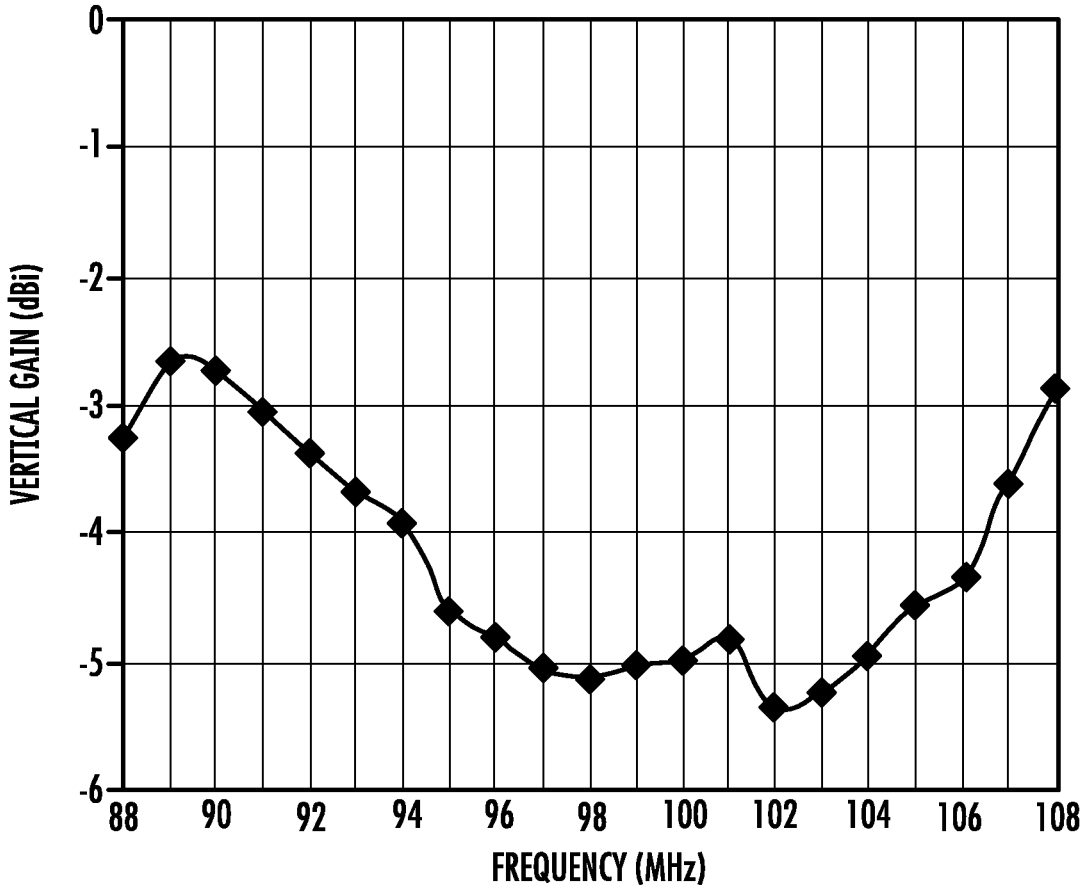
Figure 19:
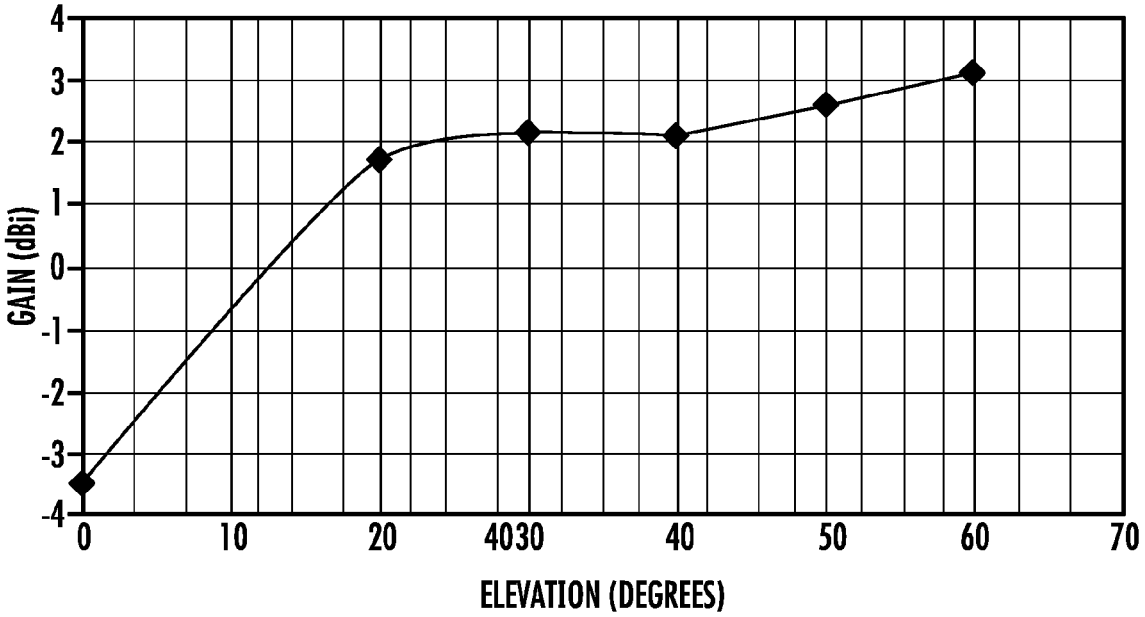
Figure 20:
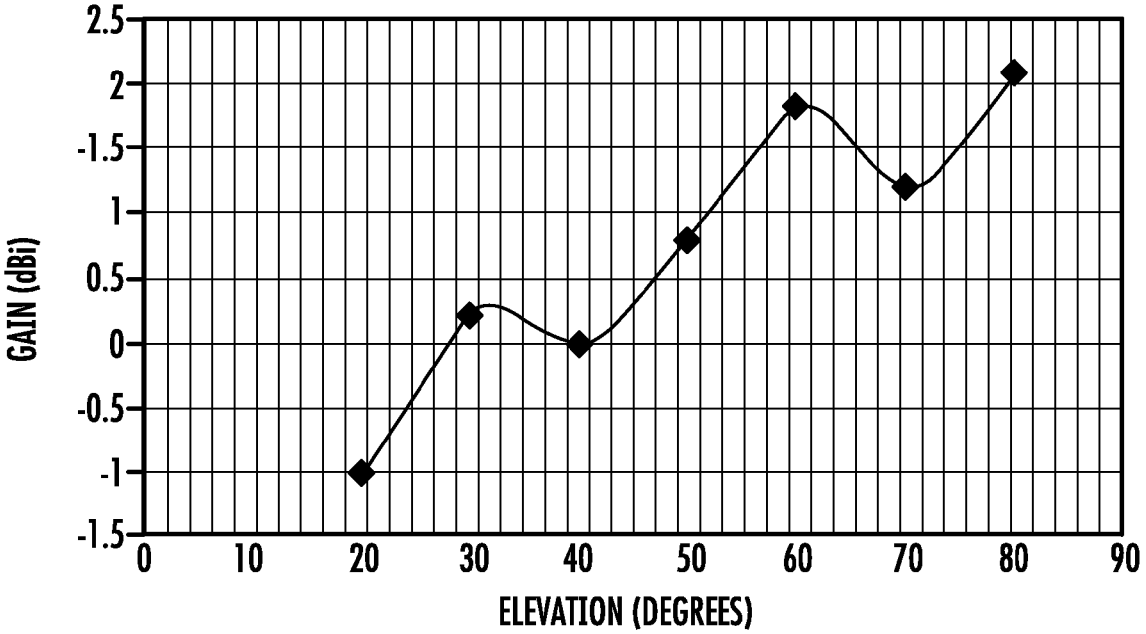
Figure 21:
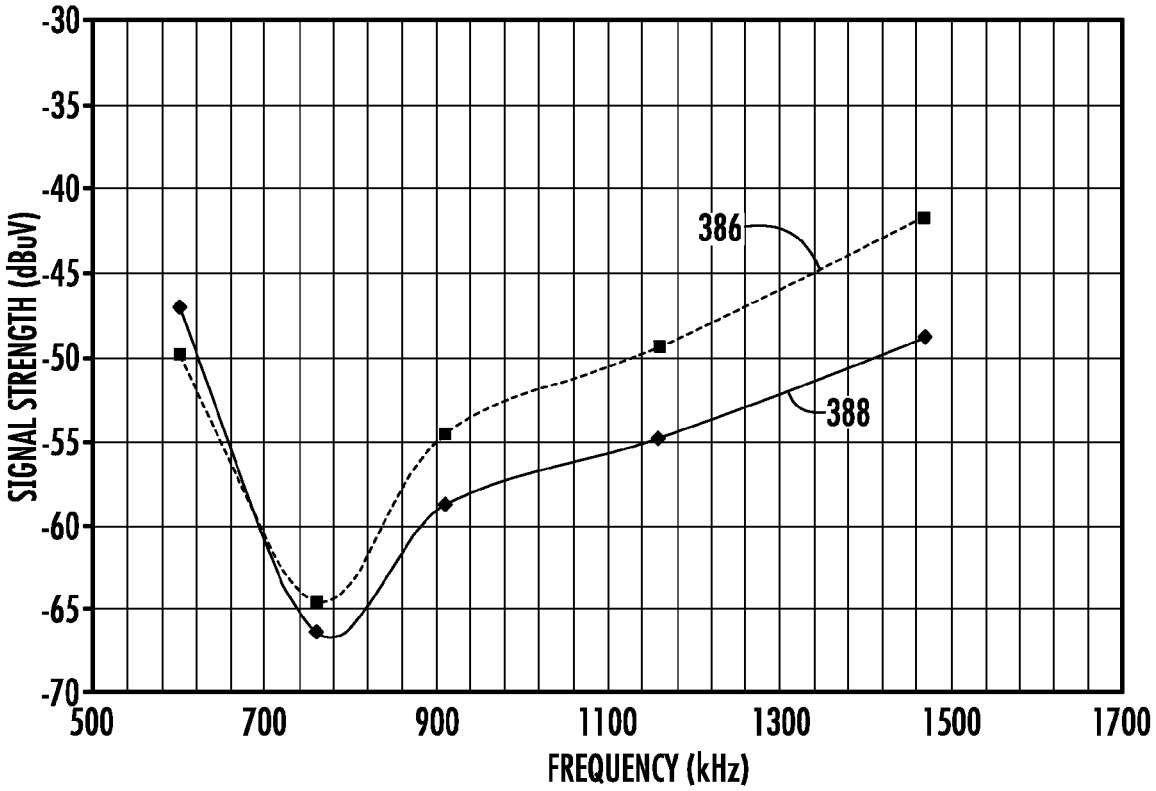

FIG. 2 with a cover of the antenna assembly removed;

FIG. 5 is a right side perspective view of the antenna assembly of FIG. 4;

FIG. 6 is another right side perspective view of the antenna assembly of FIG. 4;

FIG. 7 is a rearward perspective view of the antenna assembly of FIG. 4;

FIG. 8 is a side elevation view of an example embodiment of an antenna assembly including at least one or more aspects of the present disclosure with a cover of the antenna assembly removed;

FIG. 9 is a top plan view of the antenna assembly of FIG. 8;

FIG. 10 is a left side perspective view of an example embodiment of an antenna assembly including at least one or more aspects of the present disclosure with a cover of the antenna assembly removed;

FIG. 11 is a right side perspective view of the antenna assembly of FIG. 10;

FIG. 12 is a top plan view of an antenna of the antenna assembly of FIG. 10 configured for use with cell phones and shown adjacent a second printed circuit board of the antenna assembly of FIG. 10;

FIG. 13 is a line graph illustrating vertical gain at frequencies ranging between about 88 Megahertz (MHz) and about 108 MHz for an antenna of the antenna assembly of FIG. 10 configured for use with AM/FM radio;

FIGS. 14-18 are line graphs illustrating vertical gain for the cell phone antenna of the antenna assembly of FIG. 10 for select frequencies of the Advanced Mobile Phone System, Global System for Mobile Communications (GSM) 900, GSM 1800, Personal Communications Service, and Universal Mobile Telecommunications System;

FIG. 19 is a line graph illustrating gain at frequencies ranging between about 2,320 MHz and about 2,345 MHz at various different elevations for an antenna of the antenna assembly of FIG. 10 configured for use with satellite digital audio radio services;

FIG. 20 is a line graph illustrating gain at frequencies ranging between about 1,574 MHz and about 1,576 MHz at various different elevations for an antenna of the antenna assembly of FIG. 10 configured for use with global positioning systems; and FIG. 21 is a line graph illustrating signal strength comparison between the AM/FM antenna of the antenna assembly of FIG. 10 and a reference antenna mast.

Corresponding reference numerals indicate corresponding parts throughout the several views of the drawings.

DETAILED DESCRIPTION

Example embodiments will now be described more fully with reference to the accompanying drawings.

Example embodiments of the present disclosure are directed toward antenna assemblies comprising at least one antenna. Example antennas can include, but are not limited to, antennas configured for use with AM/FM radio, satellite digital audio radio services (SDARS), global positioning systems (GPS), digital audio broadcasting (DAB)-VHF-III, DAB-L, Wi-Fi, Wi-Max, and cell phones. In some example embodiments, the antenna assemblies include at least two antennas co-located, for example, on common chassis of the antenna assemblies, under common covers of the antenna assemblies, etc. In some example embodiments, the antenna assemblies define or are low-profile antenna assemblies in which heights of the antenna assemblies are lower than other antenna assemblies comprising similar combinations of antennas. In some example embodiments, the antenna assemblies have overall height dimensions of about 60 millimeters or less. And, in some of these example embodiments, the antenna assemblies have overall height dimensions of about 55 millimeters or less.

Figure 1:
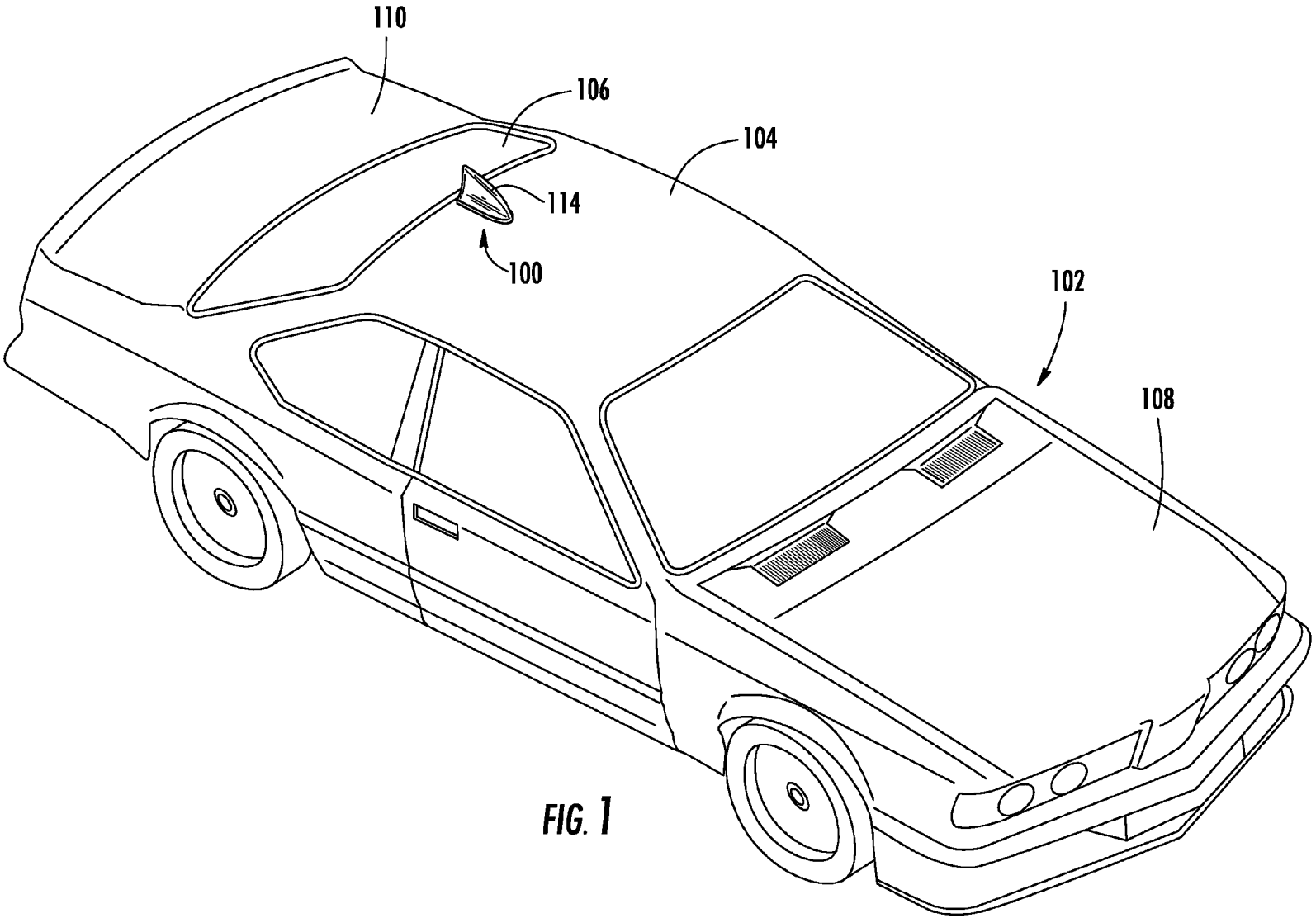
FIG. 1 is a perspective view of an example embodiment of an antenna assembly including at least one or more aspects of the present disclosure shown installed to a roof of a car.

With reference now to the drawings, FIGS. 1-7 illustrate an example embodiment of an antenna assembly 100 including at least one or more aspects of the present disclosure. FIG. 1 illustrates the antenna assembly 100 installed to a car 102 (broadly, a mobile platform). In particular, the antenna assembly 100 is shown mounted on a roof 104 of the car 102 toward a rear window 106 of the car 102 and along a longitudinal centerline of the roof 104. Here, the roof 104 of the car 102 acts as a ground plane for the antenna assembly 100. The antenna assembly 100 could, however, be mounted differently within the scope of the present disclosure. For example, the antenna assembly 100 could be mounted on a hood 108 or a trunk 110 of the car 102, etc. In addition, the antenna assembly 100 could be installed to a mobile platform other than the car 102, for example, a truck, a bus, a recreational vehicle, a boat, a vehicle without a motor, etc. within the scope of the present disclosure. U.S. Pat. No. 7,492,319 (Lindackers et al.) discloses example installations of antenna assemblies to vehicle bodies.

Figure 3:
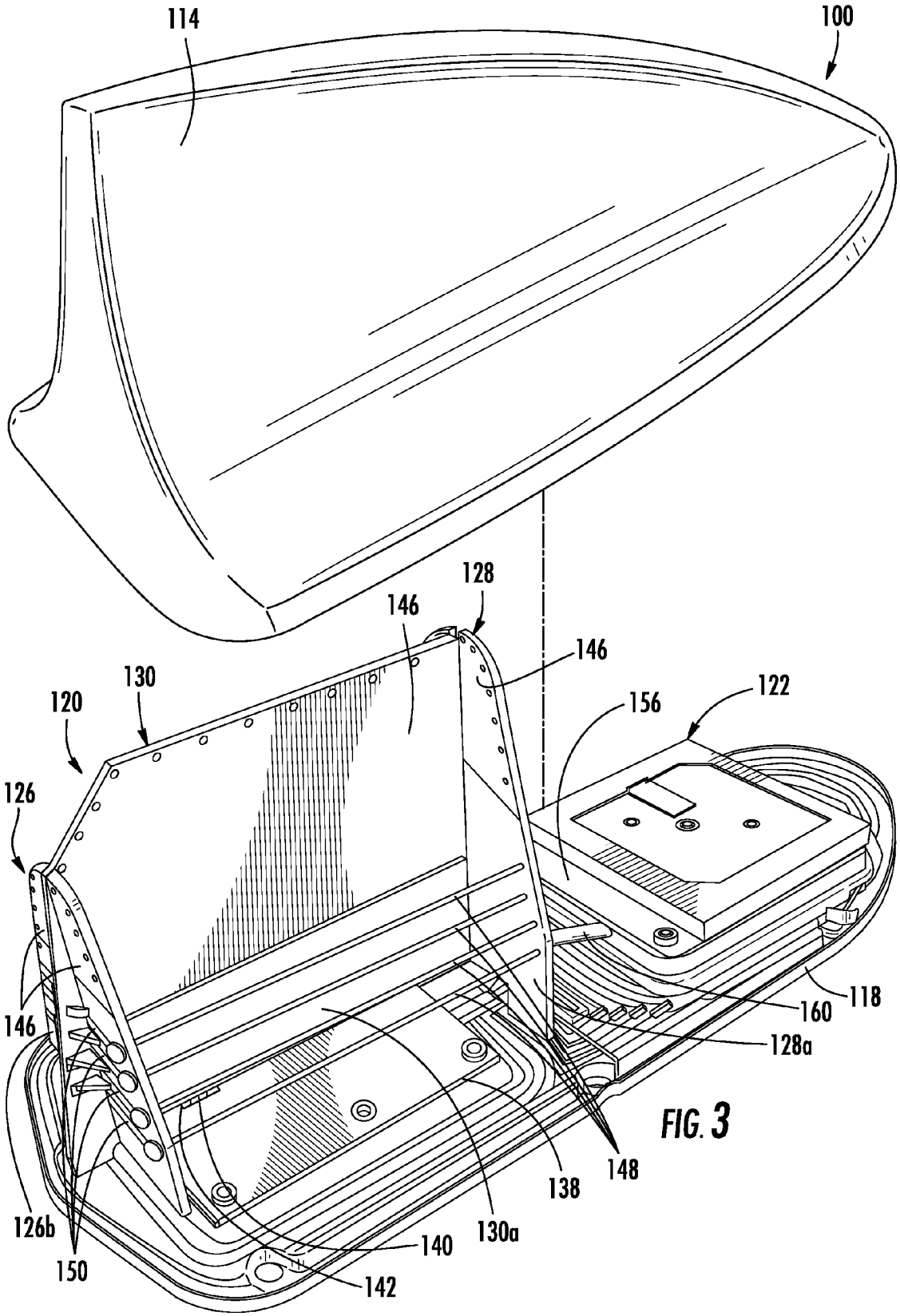
FIG. 3 is an exploded perspective view of the antenna assembly of FIG. 2.

With additional reference to FIGS. 2 and 3, the antenna assembly 100 includes a cover (or radome) 114 provided to help protect components of the antenna assembly 100 enclosed within the cover 114. For example, the cover 114 can substantially seal the components of the antenna assembly 100 within the cover 114 thereby protecting the components against ingress of contaminants (e.g., dust, moisture, etc.) into an interior enclosure of the cover 114. In addition, the cover 114 can provide an aesthetically pleasing appearance to the antenna assembly 100, and can be configured (e.g., sized, shaped, constructed, etc.) with an aerodynamic configuration. In the illustrated embodiment, for example, the cover 114 has an aesthetically pleasing, aerodynamic shark-fin configuration. In other example embodiments, however, antenna assemblies may include covers having configurations different than illustrated herein, for example, having configurations other than shark-fin configurations, etc. The cover 114 may also be formed from a wide range of materials, such as, for example, polymers, urethanes, plastic materials (e.g., polycarbonate blends, Polycarbonate-Acrylnitril-Butadien-Styrol-Copolymer (PC/ABS) blend, etc.), glass-reinforced plastic materials, synthetic resin materials, thermoplastic materials (e.g., GE Plastics Geloy® XP4034 Resin, etc.), etc. within the scope of the present disclosure.

As shown in FIG. 3, the antenna assembly 100 includes a chassis 118 (or base), and first and second antennas 120 and 122 coupled to the chassis 118 (and co-located on the chassis 118). The cover 114 is configured to fit over the first and second antennas 120 and 122 (such that the first and second antennas 120 and 122 can also be co-located under the cover 114) and secured to the chassis 118. And, the chassis 118 is configured to couple to the roof 104 of the car 102 for installing the antenna assembly 100 (and the antennas 120 and 122) to the car 102 (FIG. 1). The cover 114 may secure to the chassis 118 via any suitable operation, for example, a snap fit connection, mechanical fasteners (e.g., screws, other fastening devices, etc.), ultrasonic welding, solvent welding, heat staking, latching, bayonet connections, hook connections, integrated fastening features, etc. Alternatively, the cover 114 may connect directly to the roof 104 of the car 102 within the scope of the present disclosure. The chassis 118 may be formed from materials similar to those used to form the cover 114. For example, the chassis 118 may be injection molded from polymer. Alternatively, the chassis 118 may be formed from steel, zinc, or other material (including composites) by a suitable forming process, for example, a die cast process, etc. within the scope of the present disclosure. U.S. Pat. No. 7,429,958 (Lindackers et al.) and U.S. Pat. No. 7,755,551 (Lindackers et al.) disclose example couplings between covers and chassis of antenna assemblies.

While not shown, a sealing member (e.g., an O-ring, a resiliently compressible elastomeric or foam gasket, etc.) may be provided between the chassis 118 and the roof 104 of the car 102 for substantially sealing the chassis 118 against the roof 104. A sealing member may also, or alternatively, be provided between the cover 114 of the antenna assembly 100 and the chassis 118 for substantially sealing the cover 114 against the chassis 118.

With additional reference to FIGS. 4-7, the first antenna 120 of the illustrated antenna assembly 100 is a vertical monopole antenna configured for use with AM/FM radio (e.g., configured for receiving/transmitting desired AM/FM radio signals, etc.). As illustrated, this AM/FM antenna 120 includes first and second spaced apart end flanges 126 and 128 and a web 130 positioned generally centrally between the end flanges 126 and 128. The end flanges 126 and 128 are oriented generally parallel to each other, and the web 130 is oriented generally perpendicular to the end flanges 126 and 128. Tab portions of the web 130 interconnect with corresponding slot portions of the end flanges 126 and 128 to help align the web 130 generally centrally between the end flanges 126 and 128, and solder is used to secure the web 130 and end flanges 126 and 128 together. In the illustrated embodiment, the end flanges 126 and 128 and the web 130 are arranged to define a generally English-language capital letter H shape (e.g., when viewed from above, etc.). The end flanges 126 and 128 and the web 130 can be constructed from any suitable material within the scope of the present disclosure including, for example, printed circuit board materials, double sided printed circuit board materials, etc. In other example embodiments, antenna assemblies can include AM/FM antennas defining shapes other than English-language capital letter H shapes within the scope of the present disclosure.

The AM/FM antenna 120 is coupled to the chassis 118 of the antenna assembly 100 at a first printed circuit board (PCB) 138 located toward a rearward portion of the chassis 118. The first PCB 138 can include any suitable PCB within the scope of the present disclosure including, for example, a double-sided PCB, etc. The illustrated first PCB 138 is fastened to the chassis 118 by mechanical fasteners, and the AM/FM antenna 120 (and particularly the web 130 of the AM/FM antenna 120) is soldered to the first PCB 138. Other means for coupling the first PCB 138 to the chassis 118 and/or for coupling the AM/FM antenna 120 to the first PCB 138 may be used within the scope of the present disclosure. The web 130 of the AM/FM antenna 120 also includes a downwardly extending projection 140 that is at least partially received within a corresponding opening 142 in the first PCB 138. The projection 140 can allow the AM/FM antenna 120 to make electrical connection through the opening 142 to a PCB component (not visible) on an opposite side of the first PCB 138 as desired.

Electrically conductive plating 146 is provided toward an upper portion of the AM/FM antenna 120 for capacitively loading the web 130 (e.g., an upper portion of the web 130, etc.) and an upper portion of the AM/FM antenna 120. This capacitive loading can help increase efficiency and bandwidth of the AM/FM antenna 120. For example, it can make the AM/FM antenna 120 appear electrically longer than its actual physical size, which is important in antennas that are relatively small in volume. The conductive plating 146 is coupled to upper portions of each of the end flanges 126 and 128 and the web 130 along portions of side surfaces of each of the end flanges 126 and 128 and the web 130. As such, the plating 146 on respective side surfaces is separated (and spaced apart) by the end flanges 126 and 128 and the web 130. The plating 146 can be made from any suitable electrically conductive material within the scope of the present disclosure including, for example, metallic materials such as copper, etc., or other electrically conductive materials, etc. In addition, the plating 146 can be arranged (e.g., located, shaped, etc.) as desired within the scope of the present disclosure (e.g., a portion of the cover 114 could include the plating 146 and could provide capacitive loading of the AM/FM antenna 120, etc.), In addition, electrical conductors 148 are provided toward a lower portion of the AM/FM antenna 120 (and toward a lower portion of the web 130) for inductively loading the lower portion of the AM/FM antenna 120. This inductive loading can help increase efficiency and bandwidth of the AM/FM antenna 120. For example, it can make the AM/FM antenna 120 appear electrically longer than its actual physical size. In the illustrated embodiment, four electrical conductors 148 are located toward a first side surface 130*a* of the web 130 (FIG. 3), and three electrical conductors 148 are located toward a second side surface 130*b* of the web 130 (FIGS. 5 and 6). The electrical conductors 148 are oriented generally parallel to each other and extend between the first and second end flanges 126 and 128. The electrical conductors 148 are also oriented generally parallel to the web 130. End portions of the electrical conductors 148 extend through the end flanges 126 and 128 and connect to electrically conductive traces 150 (e.g., PCB material traces, etc.) disposed along (e.g., soldered to, etc.) outer side surfaces 126*b* and 128*b* of the end flanges 126 and 128 (FIGS. 4 and 7). Traces 150 along the outer side surface 126*b* of the first end flange 126 are electrically coupled together as desired (e.g., via soldering, etc.) across the portion of the web 130 extending through the first end flange 126 (FIGS. 3, 5, and 7). As such, the electrical conductors 148 and the traces 150 define a continuous, generally rectangular shaped, electrical path generally coiling around the AM/FM antenna 120 (e.g., around the web 130 and the end flanges 126 and 128 generally clockwise in the illustrated embodiment, etc.). The electrical conductors and/or the traces 150 can be made from any suitable electrically conductive material within the scope of the present disclosure including, for example, metallic materials such as copper, etc., or other electrically conductive materials, etc. In addition, the electrical conductors 148 can be shaped as desired including, for example, as wires, strips, traces, etc.

In other example embodiments, antenna assemblies can include AM/FM antennas in which inductively loaded portions of the AM/FM antennas include single electrical conductors continuously wrapped around the AM/FM antennas as desired. In other example embodiments, antenna assemblies can include AM/FM antennas in which inductively loaded portions of the AM/FM antennas include additional printed circuit boards extending between end flanges of the AM/FM antennas (e.g., generally parallel to webs of the AM/FM antennas, etc.) with electrically conductive traces located on the additional printed circuit boards and aligned with corresponding electrically conductive traces located on the end flanges to thereby generally define an electrical path around the AM/FM antennas. In other example embodiments, antenna assemblies can include AM/FM antennas in which inductively loaded portions of the AM/FM antennas include electrical conductors (e.g., electrical conductors and traces, single electrical conductors, traces, etc.) defining shapes other than generally rectangular (e.g., generally circular shapes, generally oval shapes, generally square shapes, any suitable large diameter coil shape, any suitable shape other than generally a round shape, any other suitable configuration, etc.). In other example embodiments, antenna assemblies can include AM/FM antennas in which capacitively loaded portions of the AM/FM antennas define configurations other than disclosed herein (e.g., suitable configurations wherein the capacitively loaded portions do not shield inductively loaded portions of the AM/FM antennas, etc.).

A coupling wire 152 electrically connects the first PCB 138 (e.g., at a feed point on the first PCB 138, etc.) to the AM/FM antenna 120. In particular, the coupling wire 152 connects to a lower trace 150*a* mounted (e.g., fastened, etc.) on an inner side surface 128*a* of the second end flange 128. This lower trace 150*a* is electrically coupled to a corresponding trace 150*b* located on the outer side surface 128*b* of the second end flange 128 (at a location adjacent point A identified in FIG. 4). This electrically connects the first PCB 138 to the electrical conductors 148 (and the AM/FM antenna 120) via interconnection of the electrical conductors 148 and the traces 150. In addition, an upper trace 150*c* mounted on an inner side surface 126*a* of the first end flange 126 is soldered to the plating 146 on the second side surface 130*b* of the web 130. This upper trace 150*c* is electrically coupled to a corresponding trace 150*d* located on the outer side surface 126*b* of the first end flange 126 (at a location adjacent point B identified in FIG. 5). This electrically connects the first PCB 138 to the plating 146 (via the coupling wire 152, the traces 150, and the electrical conductors 148). As such, the plating 146 on the web 130 acts as one half of a capacitor (e.g., as one conductive plate, etc.) and the ground under the AM/FM antenna 120 acts as the other half of the capacitor (as another conductive plate, etc.), with air therebetween acting as a separating insulator. Thus, the illustrated AM/FM antenna 120 can be viewed as one long conductor extending from the coupling wire 152 at the first PCB 138 to the capacitively loaded upper portion of the AM/FM antenna 120 (e.g., the plating 146 of the web 130, etc.), with the inductively loaded portion of the AM/FM antenna 120 (e.g., the coil portion defined by the traces 150 and the electrical conductors 148 extending between them, etc.) located therebetween.

The AM/FM antenna 120 may be operable at one or more frequencies including, for example frequencies ranging between about 140 Kilohertz (KHz) and about 110 Megahertz (MHz), etc. For example, the illustrated AM/FM antenna 120 can be resonant in the FM band (e.g., at frequencies between about 88 MHz and about 108 MHz, etc.) and can also work at AM frequencies, but may not be resonant at various AM frequencies (e.g., frequencies between about 535 KHz and about 1735 KHz, etc.). The AM/FM antenna 120 may also be tuned as desired for operation at desired frequency bands by, for example, adjusting dimensions of the end flanges 126 and 128 and/or the web 130, adjusting dimensions of the plating 146 provided toward the upper portion of the AM/FM antenna 120, adjusting size and/or number of electrical conductors 148 provided toward the lower portion of the AM/FM antenna 120, etc. For example, the AM/FM antenna 120 could be tuned (or retuned), as desired, to Japanese FM frequencies (e.g., including frequencies between about 76 MHz and about 93 MHz, etc.), DAB-VHF-III (e.g., including frequencies between about 174 MHz and about 240 MHz, etc.) other similar VHF bands, other frequency bands, etc.

With continued reference to FIGS. 4-7, the second antenna 122 of the illustrated antenna assembly 100 is a patch antenna configured for use with satellite digital audio radio services (SDARS) (e.g., Sirius Satellite Radio, XM Satellite Radio, etc.) (e.g., configured for receiving/transmitting desired SDARS signals, etc.). In the illustrated embodiment, this SDARS antenna 122 is coupled to the chassis 118 at a second PCB 156 located toward a forward portion of the chassis 118. The second PCB 156 can include any suitable PCB within the scope of the present disclosure including, for example, a double-sided PCB, etc. The second PCB 156 is fastened to the chassis 118 by mechanical fasteners, and the SDARS antenna 122 is electrically coupled to the second PCB 156 as desired and fastened thereto by a mechanical fastener. Other means for coupling the second PCB 156 to the chassis 118 and/or for coupling the SDARS antenna 122 to the second PCB 156 may be used within the scope of the present disclosure.

The SDARS antenna 122 may be operable at one or more desired frequencies including, for example, frequencies ranging between about 2,320 MHz and about 2,345 MHz, etc. The SDARS antenna 122 may also be tuned as desired for operation at desired frequency bands by, for example, changing dielectric materials, changing sizes of metal plating, etc. used in connection with the SDARS antenna 122, etc.

An electrical connector (not visible) may be attached to the first PCB 138 via cable 158 and the second PCB 156 via cable 160 for coupling the antenna assembly 100 to a suitable communication link (e.g., a coaxial cable, etc.) in the car 102 (e.g., through an opening in the chassis 118 aligned with an opening in the roof 104 of the car 102, etc.). In this way, the first and/or second PCB 138 and/or 156 may receive signal inputs from the AM/FM and/or SDARS antennas 120 and/or 122, process the signal inputs, and transmit the processed signal inputs to the suitable communication link. Alternatively, or in addition, the first and/or second PCB 138 and/or 156 may process signal inputs to be transmitted via or through the AM/FM and/or SDARS antennas 120 and/or 122. With this said, it is understood that the AM/FM and/or SDARS antennas 120 and/or 122 may receive and/or transmit radio signals as desired.

In some example embodiments, the electrical connector may be an ISO (International Standards Organization) standard electrical connector or a Fakra connector attached to the first PCB 138 via the cable 158 and the second PCB 156 via the cable 160. Accordingly, a coaxial cable (or other suitable communication link) may be relatively easily connected to the electrical connector and used for communicating signals received by the AM/FM and/or SDARS antennas 120 and/or 122 to another device, such as a radio receiver, etc. in the car 102. In such embodiments, the use of standard ISO electrical connectors or Fakra connectors may allow for reduced costs as compared to those antenna installations that require a customized design and tooling for the electrical connection between the antenna assembly 100 and cable. In addition, the pluggable electrical connections between the communication link and the electrical connector may be accomplished by the installer without the installer having to complexly route wiring or cabling through body walls of the car 102. Accordingly, the pluggable electrical connection may be easily accomplished without requiring any particular technical and/or skilled operations on the part of the installer. Alternative embodiments may include using other types of electrical connectors and communication links (e.g., pig tail connections, etc.) besides standard ISO electrical connectors, Fakra connectors, and coaxial cables.

FIGS. 8 and 9 illustrate another example embodiment of an antenna assembly 200 including at least one or more aspects of the present disclosure. The antenna assembly 200 of this embodiment is substantially the same as the antenna assembly 100 previously described and illustrated in FIGS. 1-7. For example, the antenna assembly 200 of this embodiment includes a chassis 218, and first and second antennas 220 and 222 coupled to the chassis 218. The first antenna 220 (coupled to the chassis 218 by a first PCB 238) is a vertical monopole antenna configured for use with AM/FM radio, and the second antenna 222 (coupled to the chassis 218 by a second PCB 256) is a patch antenna configured for use with SDARS. The AM/FM antenna 220 includes first and second spaced apart end flanges 226 and 228 and a web 230 positioned generally centrally between the end flanges 226 and 228.

In this embodiment, example dimensions of the AM/FM antenna 220, including of the end flanges 226 and 228 and the web 230, are provided in FIGS. 8 and 9. For example, in this embodiment a height of the AM/FM antenna 220 is about 54 millimeters, a length of the AM/FM antenna 220 is about 66 millimeters, and a width of the AM/FM antenna 220 is about 32 millimeters. As such, the first and second end flanges 226 and 228 are spaced apart a distance of about 56 millimeters, and electrical conductors 248 positioned between the first and second end flanges 226 and 228 have lengths of about 61 millimeters. In addition, the web 230 has a height of about 54 millimeters and a length of about 66 millimeters, the second end flange 228 has a height of about 54 millimeters and a width of about 32 millimeters, and the first end flange has a height of about 40 millimeters and a width of about 32 millimeters.

As can be seen from the example dimensions, the illustrated AM/FM antenna 220, and thus the illustrated antenna assembly 200 including the AM/FM antenna 220, has a relatively low-profile (as compared, for example, to other AM/FM antennas and antenna assemblies including AM/FM antennas). For example, in this embodiment the AM/FM antenna 220 has a height of about 54 millimeters and defines a footprint having a length of about 66 millimeters and a width of about 32 millimeters. In other example embodiments, antenna assemblies can include AM/FM antennas having heights of about 55 millimeters or less and defining footprints having lengths of about 66 millimeters or less and widths of about 30 millimeters or less. In other example embodiments, antenna assemblies can include AM/FM antennas having other dimensions within the scope of the present disclosure.

FIGS. 10-12 illustrate another example embodiment of an antenna assembly 300 including at least one or more aspects of the present disclosure. The antenna assembly 300 of this embodiment is similar to the antenna assembly 100 previously described and illustrated in FIGS. 1-7. For example, the antenna assembly 300 of this embodiment includes a chassis 318 configured to couple the antenna assembly 300 to a mobile platform, and first and second antennas 320 and 322 coupled to the chassis 318. In addition in this embodiment, the antenna assembly 300 includes third and fourth antennas 370 and 372 coupled to the chassis 318 (with each of the first, second, third, and fourth antennas 320, 322, 370, and 372 co-located on the chassis 318).

The first antenna 320 of the illustrated antenna assembly 300 is a vertical monopole antenna configured for use with AM/FM radio (e.g., configured for receiving/transmitting desired AM/FM radio signals, etc.). This AM/FM antenna 320 is coupled to the chassis 318 of the antenna assembly 300 at a first PCB 338 located toward a rearward portion of the chassis 318. The first PCB 338 is fastened to the chassis 318 by mechanical fasteners, and the AM/FM antenna 320 is soldered to the first PCB 338. The illustrated AM/FM antenna 320 includes first and second spaced apart end flanges 326 and 328 and a web 330 positioned generally centrally between the end flanges 326 and 328. The end flanges 326 and 328 are oriented generally parallel to each other, and the web 330 is oriented generally perpendicular to the end flanges 326 and 328. Tab portions of the web 330 interconnect with corresponding slot portions of the end flanges 326 and 328 to help align the web 330 generally centrally between the end flanges 326 and 328, and solder is used to secure the web 330 and end flanges 326 and 328 together. In the illustrated embodiment, the end flanges 326 and 328 and the web 330 are arranged to define a generally English-language capital letter H shape.

Electrically conductive plating 346 is provided toward an upper portion of the AM/FM antenna 320 for capacitively loading the web 330 (e.g., an upper portion of the web 330, etc.) and an upper portion of the AM/FM antenna 320. In particular, the plating 346 is coupled to upper portions of each of the end flanges 326 and 328 and the web 330 along opposing side surfaces of each of the end flanges 326 and 328 and the web 330.

In addition, electrically conductive electrical conductors 348 are provided toward a lower portion of the AM/FM antenna 320 (and toward a lower portion of the web 330) for inductively loading the lower portion of the AM/FM antenna 320. In the illustrated embodiment, four electrical conductors 348 are located toward a first side surface 330*a* of the web 330 (FIG. 10), and three electrical conductors 348 are located toward a second side surface 330*b* of the web 330 (FIG. 11). The electrical conductors 348 are oriented generally parallel to each other and extend between the first and second end flanges 326 and 328. The electrical conductors 348 are also oriented generally parallel to the web 330. End portions of the electrical conductors 348 extend through the end flanges 326 and 328 and connect to electrically conductive traces 350 disposed along (e.g., soldered to, etc.) outer side surfaces of the end flanges 326 and 328. As such, the electrical conductors 348 and the traces 350 define a continuous, generally rectangular shaped, electrical path generally coiling around the AM/FM antenna 320 (e.g., around the web 330 and the end flanges 326 and 328 generally clockwise in the illustrated embodiment, etc.).

A coupling wire 352 electrically connects the first PCB 338 to the AM/FM antenna 320 (in similar fashion to the coupling wire 152 of the AM/FM antenna 120 illustrated in FIGS. 3-7). In particular, the coupling wire 352 connects to a lower trace (not visible) mounted (e.g., fastened, etc.) on an inner side surface of the second end flange 328. This lower trace 350*a* is electrically coupled to a corresponding trace 350*b* located on an outer side surface of the second end flange 328. This electrically connects the first PCB 338 to the electrical conductors 348 (and the AM/FM antenna 320) via interconnection of the electrical conductors 348 and the traces 350, thereby defining an inductively loaded portion of the AM/FM antenna 320. In addition, an upper trace 350*c* mounted on an inner side surface of the first end flange 326 is soldered to the plating 346 on the second side surface 330*b* of the web 330. This upper trace 350*c* is electrically coupled to a corresponding trace (not visible) located on an outer side surface of the first end flange 326. This electrically connects the first PCB 338 to the plating 346 (via the traces 350 and electrical conductors 348), thereby defining a capacitively loaded portion of the AM/FM antenna 320.

The AM/FM antenna 320 may be operable at one or more frequencies including, for example frequencies ranging between about 140 KHz and about 110 MHz, etc. For example, the illustrated AM/FM antenna 320 can be resonant in the FM band (e.g., at frequencies between about 88 MHz and about 108 MHz, etc.) and can also work at AM frequencies, but may not at all be resonant at various AM frequencies (e.g., frequencies between about 535 KHz and about 1735 KHz, etc.). The AM/FM antenna 320 may also be tuned as desired for operation at desired frequency bands by, for example, adjusting dimensions of the end flanges 326 and 328 and/or the web 330, adjusting dimensions of the plating 346 provided toward the upper portion of the AM/FM antenna 320, adjusting size and/or number of electrical conductors 348 provided toward the lower portion of the AM/FM antenna 320, etc. For example, the AM/FM antenna 120 could be tuned (or retuned), as desired, to Japanese FM frequencies (e.g., including frequencies between about 76 MHz and about 93 MHz, etc.), DAB-VHF-III (e.g., including frequencies between about 174 MHz and about 240 MHz, etc.) other similar VHF bands, other frequency bands, etc.

The second antenna 322 of the illustrated antenna assembly 300 is a patch antenna configured for use with SDARS (e.g., configured for receiving/transmitting desired SDARS signals, etc.). This SDARS antenna 322 is coupled to the chassis 318 at a second PCB 356 located toward a forward portion of the chassis 318. The second PCB 356 is fastened to the chassis 318 by mechanical fasteners, and the SDARS antenna 322 is electrically coupled to the second PCB 356 as desired and fastened thereto by a mechanical fastener. The SDARS antenna 322 may be operable at one or more desired frequencies including, for example, frequencies ranging between about 2,320 MHz and about 2,345 MHz, etc. The SDARS antenna 322 may also be tuned as desired for operation at desired frequency bands by, for example, changing dielectric materials, changing sizes of metal plating, etc. used in connection with the SDARS antenna 322, etc.

The third antenna 370 is a patch antenna configured for use with global positioning systems (GPS) (e.g., configured for receiving/transmitting desired GPS signals, etc.). This GPS antenna 370 is coupled to the chassis 318 via the second PCB 356 at a location adjacent the SDARS antenna 322. Alternatively, the GPS antenna 370 could be stacked with the SDARS antenna 322 (one on top of the other) on the second PCB 356. The GPS antenna 370 is electrically coupled to the second PCB 356 as desired and fastened thereto, for example, by a mechanical fastener, etc. As such, the SDARS antenna 322 and the GPS antenna 370 are co-located on the second PCB 356. The GPS antenna 370 may be operable at one or more desired frequencies including, for example, frequencies ranging between about 1,574 MHz and about 1,576 MHz, etc. And, the GPS antenna 370 may also be tuned as desired for operation at desired frequency bands by, for example, changing dielectric materials, changing sizes of metal plating, etc. used in connection with the GPS antenna 370, etc.

The fourth antenna 372 is a vertical monopole antenna configured for use with cell phones (e.g., for receiving/transmitting desired cell phone signals, etc.). This cell phone antenna 372 is coupled to the chassis 318 at the second PCB 356 at a location adjacent the SDARS antenna 322. In particular, a base 378 of the cell phone antenna 372 couples to the second PCB 356. As shown in FIG. 12, tabs 378*a-c* of the base 378 are configured to fit in corresponding openings 356*a-c* defined in the second PCB 356 and then be soldered to the second PCB 356 (for supporting the cell phone antenna 372 generally above the second PCB 356). As such, the SDARS antenna 322, the GPS antenna 370, and the cell phone antenna 372 co-located on the second PCB 356.

The cell phone antenna 372 includes first and second conductors 374 and 376 (or radiating elements) positioned along the base 378, which is generally vertically oriented relative to the second PCB 356. The first and second conductors 374 and 376 are soldered to the second PCB 356 at the central tab 378*b* of the base 378 for electrically connecting the cell phone antenna 372 to the second PCB 356. The first and second conductors 374 and 376 are oriented such that the first conductor 374 is generally centrally located on the base 378 and the second conductor 376 extends generally around the first conductor 374 (generally along a perimeter of the base 378). An open slot 380 is defined between the first and second conductors 374 and 376 for partitioning or separating the conductors 374 and 376. The open slot 380 is preferably configured to help provide impedance matching to the cell phone antenna 372 (which may help improve power transfer for the cell phone antenna 372). The base 378 of the cell phone antenna 372 can be constructed from any suitable material within the scope of the present disclosure including, for example, printed circuit board materials, double sided printed circuit board materials, etc. And, the first and second conductors 374 and 376 can be made from any suitable electrically conductive material within the scope of the present disclosure including, for example, metallic materials such as copper, etc., or other electrically conductive materials, etc.

The cell phone antenna 372 may be operable at one or more desired frequencies including, for example frequencies associated with the Global System for Mobile Communications (GSM) 850, the GSM 900, the GSM 1800, the GSM 1900, the Personal Communications Service (PCS), the Universal Mobile Telecommunications System (UMTS), the Advanced Mobile Phone System (AMPS), etc. AMPS typically operates in the 800 MHz frequency band; GSM typically operates in the 900 MHz and 1800 MHz frequency bands in Europe, but in the 850 MHz and 1900 MHz frequency bands in the United States; PCS typically operates in the 1900 MHz frequency band; and UMTS typically operates in the 1900 MHz to 1980 MHz frequency band for uplinks and in the 2110 MHz to 2170 MHz frequency band for downlinks.

As an example, the first conductor 374 may be tuned to receive frequencies over a bandwidth ranging from about 1,650 MHz to about 2,700 MHz, including those frequencies associated with the PCS. And, the second conductor 376 may be tuned to receive frequencies over a bandwidth ranging from about 800 MHz to about 1,000 MHz, including those frequencies associated with the AMPS. Thus, the illustrated cell phone antenna 372 can be viewed as a dual band cell phone antenna 372, operable over multiple bands of frequencies. Multiple cell phones may thus be used in connection with the cell phone antenna 372. The cell phone antenna 372 can be tuned as desired for operation at desired frequency bands by, for example, adjusting configurations (e.g., dimensions, shapes, materials, etc.) of the conductors 374 and 376, etc.

An electrical connector (not shown) may be attached to the first PCB 338 and the second PCB 356 for coupling the antenna assembly 300 to a suitable communication link (e.g., a coaxial cable, etc.) in a mobile platform. In this way, the first and/or second PCB 338 and/or 356 may receive signal inputs from the antennas 320, 322, 370, and/or 372, process the signal inputs, and transmit the processed signal inputs to the suitable communication link. Alternatively, or in addition, the first and/or second PCB 338 and/or 356 may process signal inputs to be transmitted via or through the antennas 320, 322, 370, and/or 372. With this said, it is understood that the antennas 320, 322, 370, and/or 372 may receive and/or transmit radio signals as desired.

In addition, a cover (not shown) may be provided to help protect the components (e.g., the antennas 320, 322, 370, and 372, the PCBs 338 and 356, etc.) of the antenna assembly 300 when enclosed within the cover. For example, the cover can be configured to couple to the chassis 318 and substantially seal the components of the antenna assembly 300 within the cover, thereby protecting the components against ingress of contaminants (e.g., dust, moisture, etc.) into an interior enclosure of the cover. This also allows the antennas 320, 322, 370, and 372 of the antenna assembly 300 to be co-located under the cover (and together coupled to a mobile platform as desired).

In some example embodiments, the second antenna 322 and/or the third antenna 370 could be configured to receive and/or transmit frequencies associated with Wi-Fi and/or Wi-Max (e.g., frequencies in the 2400 MHz band), frequencies associated with DAB-VHF-III (e.g., frequencies between about 170 MHz and about 230 MHz, etc.) and/or frequencies associated with DAB-L (e.g., frequencies between about 1,452 MHz and about 1,492 MHz, etc.) (see, e.g., U.S. Pat. No. 7,489,280, the entire disclosure of which is incorporated herein by reference, etc.).

In some example embodiments, antenna assemblies of the present disclosure can include antennas (alone or in combination with one or more antennas (e.g., with one or more antennas disclosed herein, etc.)) configured to receive and/or transmit frequencies associated with WiFi and/or Wi-Max (e.g., frequencies in the 2400 MHz band). In these embodiments, diplexer circuits may be used to separate cell phone signals from Wi-Fi and/or Wi-max signals, both when receiving and transmitting. In some example embodiments, antenna assemblies of the present disclosure can include antennas (alone or in combination with one or more antennas (e.g., with one or more antennas disclosed herein, etc.)) configured to receive and/or transmit frequencies associated with DAB-VHF-III (e.g., frequencies between about 170 MHz and about 230 MHz, etc.) and/or frequencies associated with DAB-L (e.g., frequencies between about 1,452 MHz and about 1,492 MHz, etc.).

Antenna assemblies of the present disclosure have generally smaller sizes (e.g., shorter heights due to no masts, etc.) than other antenna assemblies known in the art. In addition, antenna assemblies of the present disclosure allow for packaging of multiple antennas within single structures, which can provide ease of assembly at manufacturing sites as well as decreased costs as compared to requiring use of multiple different antenna assemblies (e.g., with each antenna assembly having a single antenna, etc.).

EXAMPLE

The following example is exemplary in nature. Variations of the following example are possible without departing from the scope of the disclosure.

In this example, the antenna assembly 300 illustrated in FIGS. 10-12 was analyzed for gain and signal strength. The antenna assembly 300 was installed to a roof of a car, with the AM/FM antenna 320 and the cell phone antenna 372 oriented generally vertically and generally perpendicularly to the roof. Here, the roof of the car served as a ground plane for the antenna assembly 300. Gain is an important characteristic of antennas as it represents the ability of antennas to receive and/or transmit signals from/to far away distances. And, gain can be measured at various different angles to indicate this ability at those angles. Generally, antennas with larger gains are desirable.

FIGS. 13-20 illustrate various gain measurements (measured in decibels isotropic (dBi)) for the different antennas of the antenna assembly 300 when the antenna assembly 300 is coupled to the roof of a car. The illustrated gain numbers generally show that the antenna assembly 300 was capable of achieving similar gains to larger sized antenna assemblies generally known in the art.

FIG. 13 is a line graph (with corresponding data shown in Table 1) illustrating vertical gain for the AM/FM antenna 320 for frequencies ranging from about 88 MHz to about 108 MHz.

TABLE 1

Example Vertical Gain for AM/FM Antenna

| Frequency (MHz) | Vertical Gain (dBi) |
|---|---|
| 88 | −3.24 |
| 89 | −2.65 |
| 90 | −2.72 |
| 91 | −3.05 |
| 92 | −3.37 |
| 93 | −3.66 |
| 94 | −3.92 |
| 95 | −4.60 |
| 96 | −4.82 |
| 97 | −5.06 |
| 98 | −5.12 |
| 99 | −5.03 |
| 100 | −4.99 |
| 101 | −4.80 |
| 102 | −5.35 |
| 103 | −5.22 |
| 104 | −4.94 |
| 105 | −4.56 |
| 106 | −4.35 |
| 107 | −3.62 |
| 108 | −2.88 |

Figure 14:
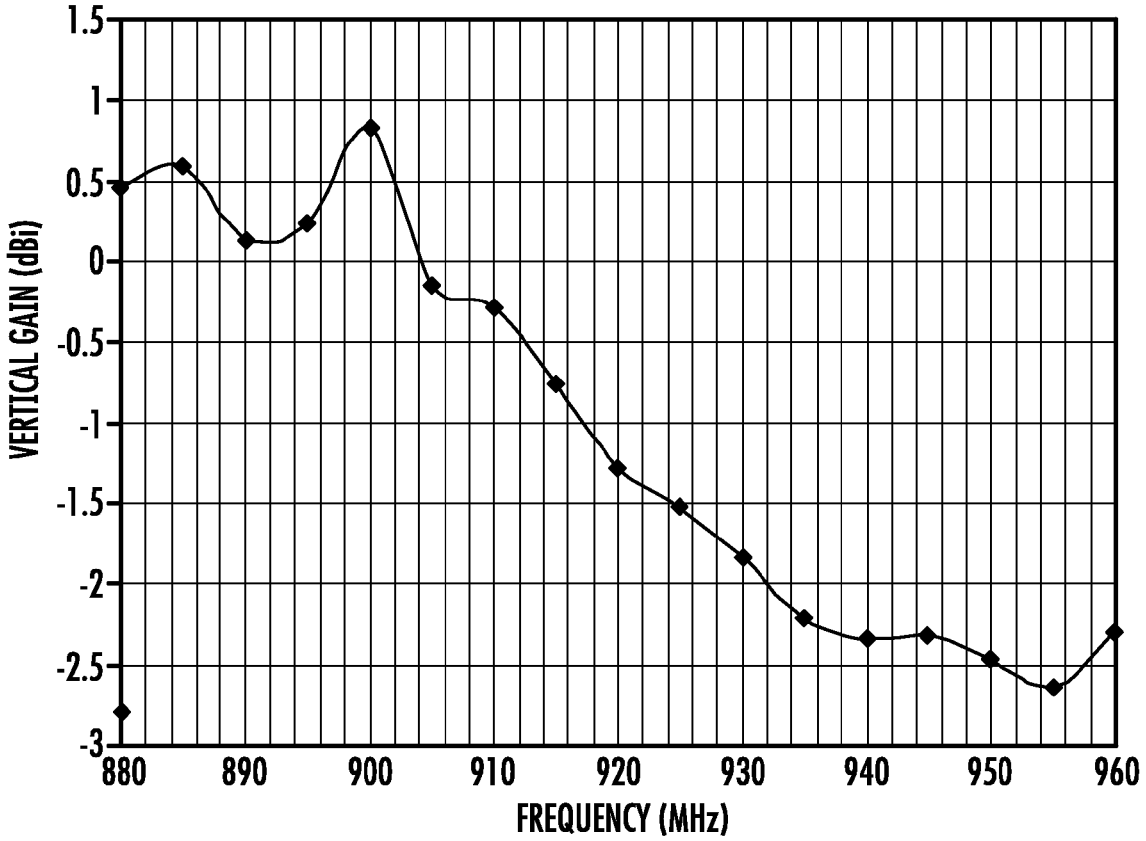
Figure 15:
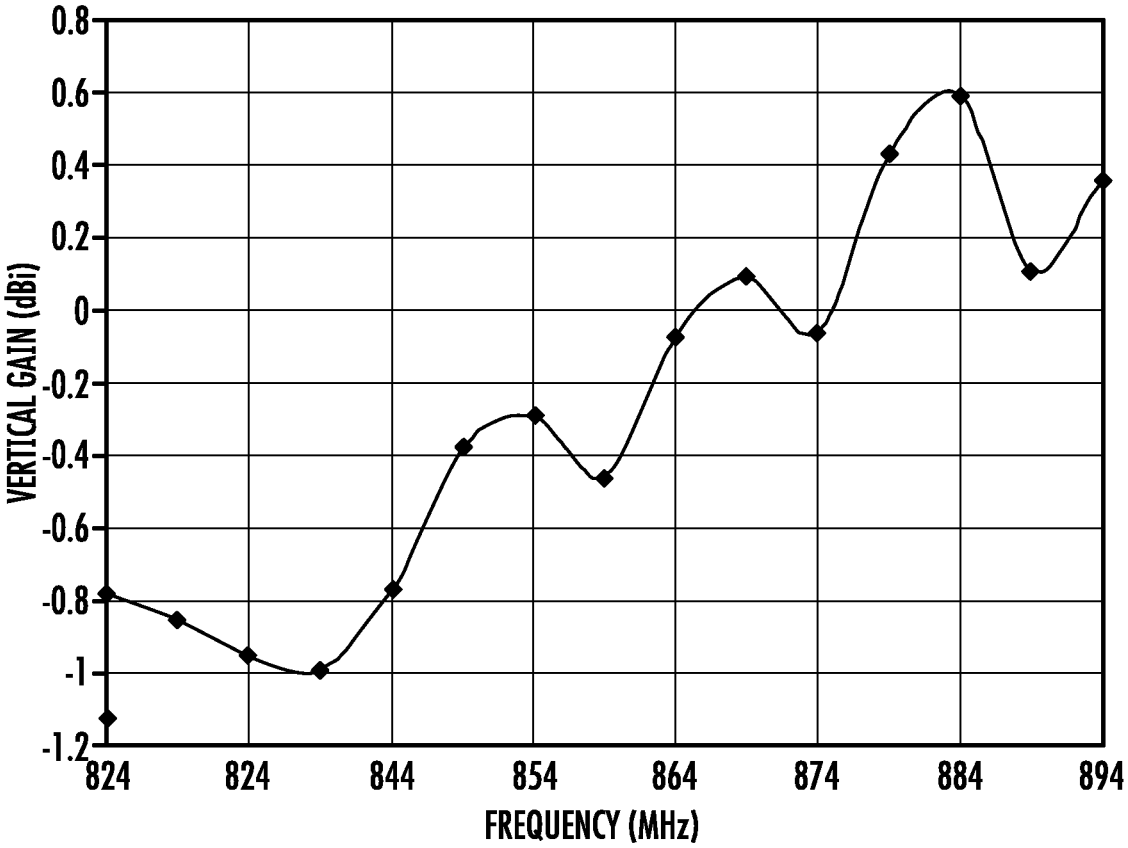
Figure 16:
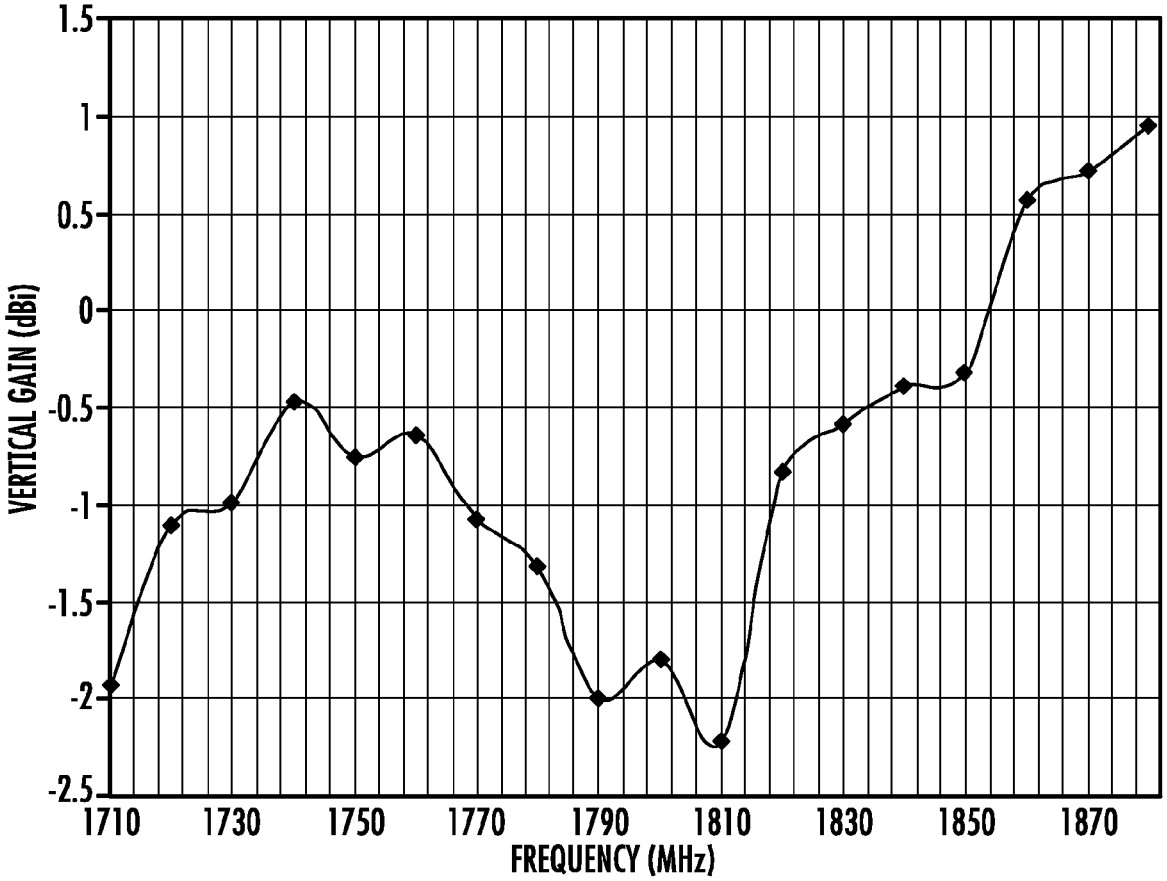
Figure 17:
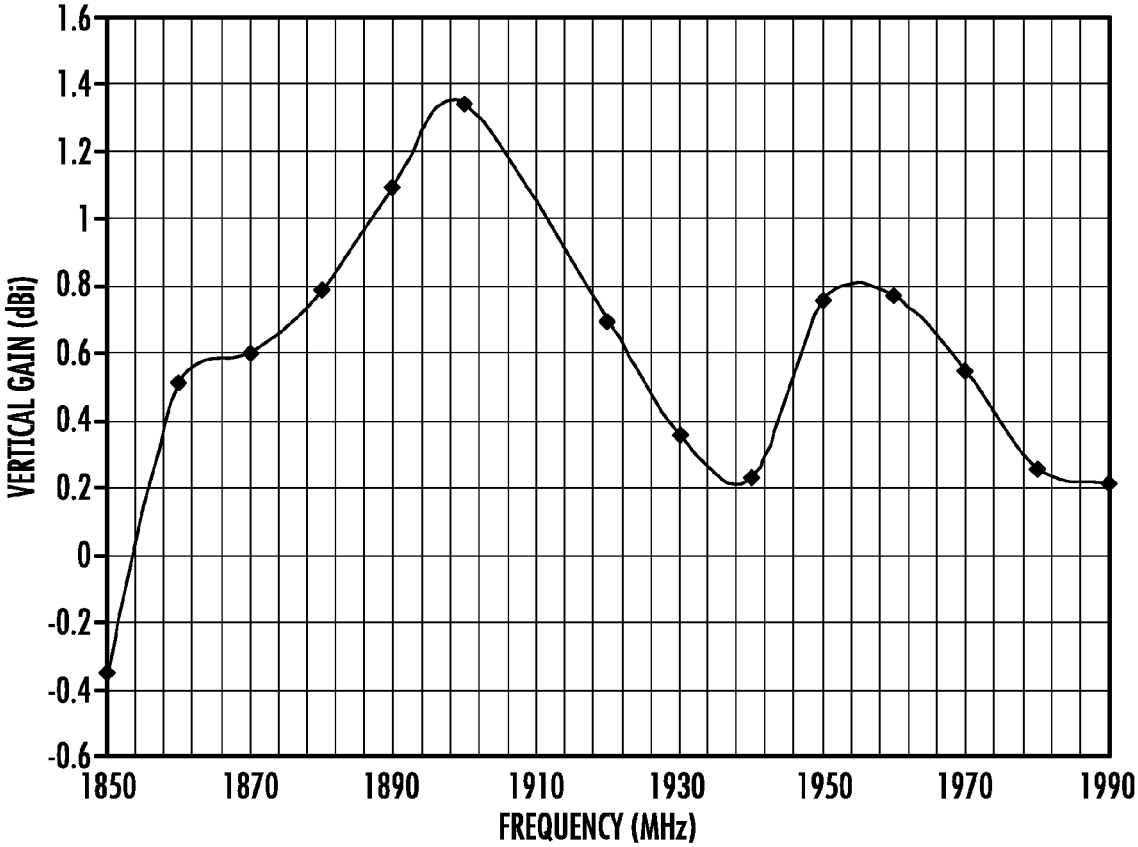
Figure 18:
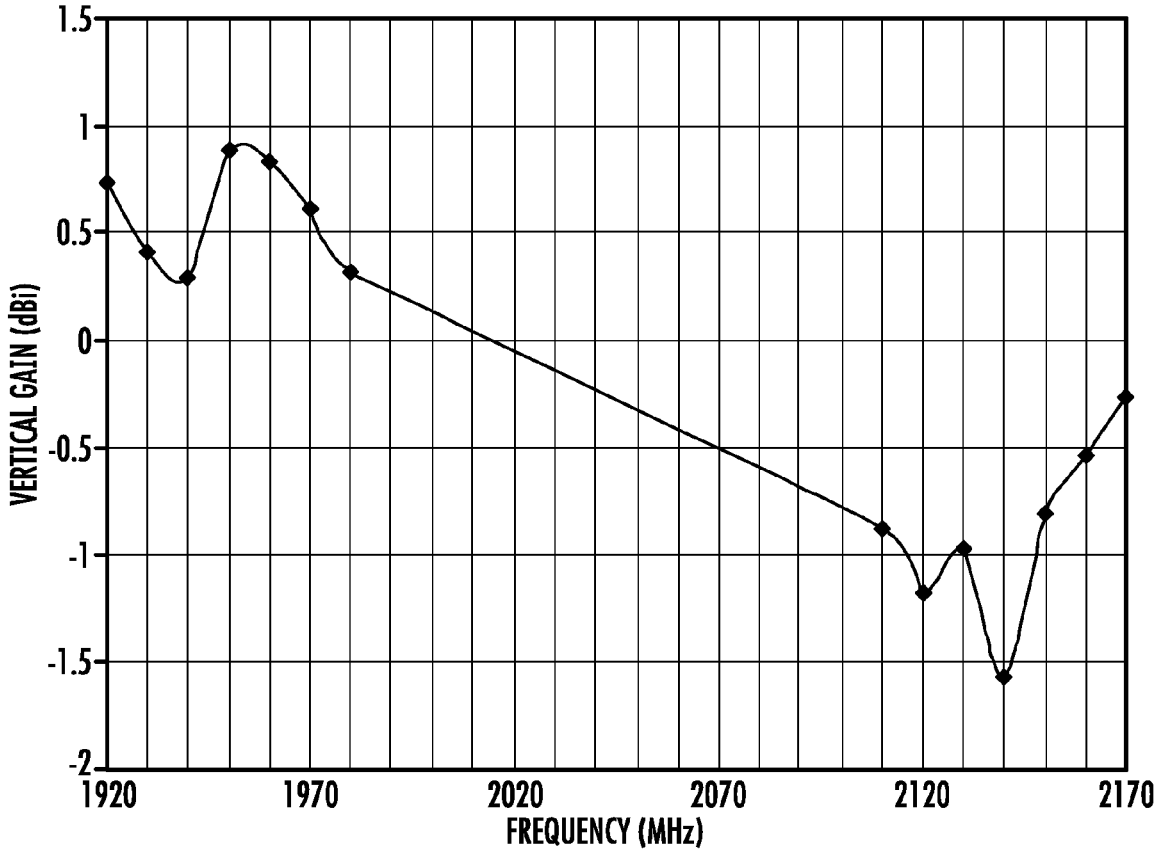

FIG. 14 is a line graph (with corresponding data shown in Table 2) illustrating vertical gain for the cell phone antenna 372 for select frequencies of the AMPS (e.g., frequencies ranging from about 824 MHz to about 894 MHz, etc.). FIG. 15 is a line graph (with corresponding data shown in Table 3) illustrating vertical gain for the cell phone antenna 372 for select frequencies of the GSM 900 (e.g., frequencies ranging from about 880 MHz to about 960 MHz, etc.). FIG. 16 is a line graph (with corresponding data shown in Table 4) illustrating vertical gain for the cell phone antenna 372 for select frequencies of the GSM 1800 (e.g., frequencies ranging from about 1710 MHz to about 1880 MHz, etc.). FIG. 17 is a line graph (with corresponding data shown in Table 5) illustrating vertical gain for the cell phone antenna 372 for select frequencies of the PCS (e.g., frequencies ranging from about 1850 MHz to about 1990 MHz, etc.). And, FIG. 18 is a line graph (with corresponding data shown in Table 6) illustrating vertical gain for the cell phone antenna 372 for select frequencies of the UMTS (e.g., frequencies ranging from about 1920 MHz to about 2170 MHz, etc.).

TABLE 2

Example Vertical Gain for Cell Phone Antenna for Frequencies Associated with AMPS

| Frequency (MHz) | Vertical Gain (dBi) |
|---|---|
| 824 | −0.78 |
| 829 | −0.85 |
| 834 | −0.95 |
| 839 | −0.99 |
| 844 | −0.77 |
| 849 | −0.38 |
| 854 | −0.29 |
| 859 | −0.46 |
| 864 | −0.07 |
| 869 | 0.09 |
| 874 | −0.06 |
| 879 | 0.43 |
| 884 | 0.59 |
| 889 | 0.11 |
| 894 | 0.36 |

TABLE 3

Example Vertical Gain for Cell Phone Antenna for Frequencies Associated with GSM 900

| Frequency (MHz) | Vertical Gain (dBi) |
|---|---|
| 880 | 0.46 |
| 885 | 0.59 |
| 890 | 0.14 |
| 895 | 0.23 |
| 900 | 0.83 |
| 905 | −0.15 |
| 910 | −0.28 |
| 915 | −0.76 |
| 920 | −1.28 |
| 925 | −1.52 |
| 930 | −1.83 |
| 935 | −2.22 |
| 940 | −2.34 |
| 945 | −2.32 |
| 950 | −2.47 |
| 955 | −2.64 |
| 960 | −2.3 |

TABLE 4

Example Vertical Gain for Cell Phone Antenna for Frequencies Associated with GSM 1800

| Frequency (MHz) | Vertical Gain (dBi) |
|---|---|
| 1710 | −1.93 |
| 1720 | −1.1 |
| 1730 | −0.99 |
| 1740 | −0.47 |
| 1750 | −0.76 |
| 1760 | −0.64 |
| 1770 | −1.07 |
| 1780 | −1.32 |
| 1790 | −2 |

TABLE 4-continued

| Example Vertical Gain for Cell Phone Antenna for Frequencies Associated with GSM 1800 | |
|---|---|
| Frequency (MHz) | Vertical Gain (dBi) |
| 1800 | −1.8 |
| 1810 | −2.22 |
| 1820 | −0.84 |
| 1830 | −0.59 |
| 1840 | −0.4 |
| 1850 | −0.33 |
| 1860 | 0.57 |
| 1870 | 0.71 |
| 1880 | 0.95 |

TABLE 5

| Example Vertical Gain for Cell Phone Antenna for Frequencies Associated with PCS | |
|---|---|
| Frequency (MHz) | Vertical Gain (dBi) |
| 1850 | −0.35 |
| 1860 | 0.51 |
| 1870 | 0.6 |
| 1880 | 0.79 |
| 1890 | 1.09 |
| 1900 | 1.34 |
| 1920 | 0.7 |
| 1930 | 0.36 |
| 1940 | 0.23 |
| 1950 | 0.76 |
| 1960 | 0.77 |
| 1970 | 0.55 |
| 1980 | 0.26 |
| 1990 | 0.21 |

TABLE 6

| Example Vertical Gain for Cell Phone Antenna for Frequencies Associated with UMTS | |
|---|---|
| Frequency (MHz) | Vertical Gain (dBi) |
| 1920 | 0.74 |
| 1930 | 0.41 |
| 1940 | 0.3 |
| 1950 | 0.891 |
| 1960 | 0.84 |
| 1970 | 0.61 |
| 1980 | 0.32 |
| 2110 | −0.88 |
| 2120 | −1.18 |
| 2130 | −0.98 |
| 2140 | −1.57 |
| 2150 | −0.81 |
| 2160 | −0.54 |
| 2170 | −0.26 |

FIG. 19 is a line graph (with corresponding data shown in Table 7) illustrating gain for the SDARS antenna 322 for frequencies ranging from about 2,320 MHz and about 2,345 MHz at various different elevations. And, FIG. 20 is a line graph (with corresponding data shown in Table 8) illustrating gain for the GPS antenna 370 for frequencies ranging from about 1,574 MHz and about 1,576 MHz at various different elevations.

TABLE 7

| Example Gain for SDARS Antenna at Different Elevations | |
|---|---|
| Elevation (degrees) | Gain (dBi) |
| 0 | −3.5 |
| 20 | 1.75 |
| 30 | 2.2 |
| 40 | 2.1 |
| 50 | 2.6 |
| 60 | 3.1 |

TABLE 8

| Example Gain for GPS Antenna at Different Elevations | |
|---|---|
| Elevation (degrees) | Gain (dBi) |
| 20 | −1 |
| 30 | 0.2 |
| 40 | 0 |
| 50 | 0.8 |
| 60 | 1.8 |
| 70 | 1.2 |
| 80 | 2.1 |

FIG. 21 is a line graph illustrating signal strength comparison between the AM/FM antenna 320 and a reference antenna mast. In this example, the AM/FM antenna 320 had a height of about 54 mm. The reference antenna mast was a solid rod mast having a length of about 80 centimeters, and that was resonant in the middle of the U.S. FM band (at a frequency of about 98 MHz). This reference mast was used as a standard of comparison for the AM/FM antenna 320. Line 386 identifies signal strength for the AM/FM antenna 320, and line 388 identifies signal strength for the reference antenna mast. Corresponding data is provided in Table 8. Signal strength is measured in decibels relative to one microvolt (dBμV). As can be seen, signal strength 386 for the AM/FM antenna 320 was generally higher (or stranger) than signal strength 388 for the reference antenna mast for frequencies between at least about 760 KHz and about 1470 KHz.

TABLE 9

| Signal Strength Comparison Between Reference Antenna and AM/FM Antenna | | |
|---|---|---|
| Frequency (KHz) | Reference Antenna Signal Strength (dBμV)) | AM/FM Antenna Signal Strength (dBμV) |
| 600 | −47 | −49.8 |
| 760 | −66.4 | −64.6 |
| 910 | −58.7 | −54.5 |
| 1160 | −54.8 | −49.3 |
| 1470 | −48.8 | −41.7 |

The specific materials and dimensions provided herein are for purposes of illustration only as antenna assemblies (and their antennas) may be configured from different materials and/or with different dimensions depending, for example, on the particular end use and/or frequencies intended for the antenna assemblies The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. Similarly, the terms "can" and "may" and their variants are intended to be non-limiting, such that recitation that an embodiment can or may comprise certain elements or features does not exclude other embodiments of the present technology that do not contain those elements or features. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The headings (such as "Background" and "Summary") and sub-headings used herein are intended only for general organization of topics within the present technology, and are not intended to limit the disclosure of the present technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof.

As used herein, the words "preferred" and "preferably" refer to embodiments of the technology that afford certain benefits, under certain circumstances. But other embodiments may also be preferred, under the same or other circumstances. Furthermore, the recitation of one or more preferred embodiments does not imply that other embodiments are not useful, and is not intended to exclude other embodiments from the scope of the technology.

Disclosure of values and ranges of values for specific parameters (such as dimensions, etc.) are not exclusive of other values and ranges of values useful herein. It is envisioned that two or more specific exemplified values for a given parameter may define endpoints for a range of values that may be claimed for the parameter. For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An antenna configured for use with AM/FM radio, the antenna comprising:

a first end flange;

a second end flange spaced apart from the first end flange;

a web positioned generally between the first end flange and the second end flange, the web extending between the first end flange and the second end flange and being oriented generally perpendicular to the first end flange and the second end flange, the web having first and second opposing side surfaces; and electrical conductors extending between the first end flange and the second end flange, at least one of the electrical conductors located toward the first side surface of the web and at least one of the electrical conductors located toward the second side surface of the web.

2. The antenna of claim 1, wherein the web defines a capacitively loaded portion of the antenna and the electrical conductors define an inductively loaded portion of the antenna.

3. The antenna of claim 2, wherein:

the web includes an upper portion and a lower portion, the upper portion of the web defining the capacitively loaded portion of the antenna; and the electrical conductors are located toward the lower portion of the web.

4. The antenna of claim 3, wherein the upper portion of the web includes electrically conductive plating defining the capacitively loaded portion of the antenna.

5. The antenna of claim 1, wherein the first end flange is oriented substantially parallel to the second end flange.

6. The antenna of claim 1, wherein the first end flange, the second end flange, and the web define a generally English-language capital letter H shape when viewed from above.

7. The antenna of claim 1, wherein the electrical conductors are oriented substantially parallel to the web.

8. The antenna of claim 1, wherein the electrical conductors are interconnected by electrically conductive traces disposed along at least part of the first end flange and/or along at least part of the second end flange.

9. The antenna of claim 1, wherein the electrical conductors include four electrical conductors located toward the first side surface of the web and three electrical conductors located toward the second side surface of the web.

10. The antenna of claim 1, wherein the electrical conductors include wires.

11. The antenna of claim 1, wherein the antenna is configured for operation at one or more frequencies ranging between about 140 kilohertz and about 110 megahertz.

12. The antenna of claim 1, wherein a height of the antenna is about 55 millimeters or less.

13. The antenna of claim 10, wherein the antenna defines a footprint having a length of about 65 millimeters or less and a width of about 30 millimeters or less.

14. An antenna assembly comprising the antenna of claim 1 in combination with at least one additional antenna, the antenna and the at least one additional antenna being co-located on a common base.

15. A low-profile antenna assembly suitable for use with a mobile platform, the antenna assembly comprising:

a chassis; and at least two antennas co-located on the chassis;

wherein at least one of the at least two antennas includes a first antenna operable at one or more frequencies ranging between about 140 kilohertz and about 110 megahertz;

wherein the first antenna includes electrical conductors establishing an electrical path around at least part of the first antenna and thereby defining an inductively loaded portion of the first antenna; and wherein an upper portion of the first antenna defines a capacitively loaded portion of the first antenna.

16. The antenna assembly of claim 15, wherein the antenna assembly has a height of about 55 millimeters or less, and/or wherein the upper portion of the antenna includes electrically conductive plating defining the capacitively loaded portion of the first antenna.

17. The antenna assembly of claim 15, wherein at least one of the at least two or more antennas includes a second antenna configured for use with at least one or more of cell phones, satellite digital audio radio services, global positioning systems, Wi-Fi, Wi-Max, and digital audio broadcasting.

18. The antenna assembly of claim 15, wherein:

the first antenna includes a first side surface and an opposing second side surface; and the electrical conductors comprise multiple electrical conductors along the first side surface of the first antenna and multiple electrical conductors along the opposing second side surface of the first antenna that are interconnected with the multiple electrical conductors along the first side surface, such that the interconnected multiple electrical conductors define a continuous electrical path generally coiling around the at least part of the first antenna.

19. The antenna assembly of claim 15, wherein:

the first antenna comprises a printed circuit board; and the electrical conductors are defined by traces located on first and/or second side surfaces of the printed circuit board.

20. The antenna assembly of claim 19, wherein the printed circuit board further includes electrically conductive plating defining the capacitively loaded portion of the first antenna.

21. A low-profile antenna assembly suitable for use with a mobile platform, the antenna assembly comprising:

a chassis; and at least two antennas co-located on the chassis;

wherein at least one of the at least two antennas includes a first antenna operable at one or more frequencies ranging between about 140 kilohertz and about 110 megahertz; and wherein the antenna assembly has a height of about 60 millimeters or less;

wherein the first antenna includes:

a first end flange;

a second end flange;

a web positioned at least partly between the first end flange and the second end flange; and electrical conductors extending between the first end flange and the second end flange;

wherein the web defines a capacitively loaded portion of the first antenna and the electrical conductors define an inductively loaded portion of the first antenna.

22. An antenna assembly suitable for use with a mobile platform, the antenna assembly comprising:

a chassis configured to be mounted on a mobile platform;

a first antenna coupled to the chassis and configured for use with AM/FM radio, the first antenna having first and second end flanges and a web positioned generally between the first and second end flanges such that the first antenna defines a generally English-language capital letter H shape, and electrical conductors extending between the first and second end flanges, the web defining a capacitively loaded portion of the first antenna and the electrical conductors defining an inductively loaded portion of the first antenna; and a second antenna coupled to the chassis and configured for use with at least one or more of cell phones, satellite digital audio radio services, global positioning systems, Wi-Fi, Wi-Max, and digital audio broadcasting;

wherein the AM/FM antenna has a height of about 55 millimeters or less and defines a footprint having a length of about 65 millimeters or less and a width of about 30 millimeters or less.

23. The antenna assembly of claim 22, wherein the second antenna is configured for use with satellite digital audio radio services.

24. The antenna assembly of claim 22, wherein the second antenna is configured for use with global positioning systems, the antenna assembly further comprising a third antenna configured for use with cell phones and a fourth antenna configured for use with Wi-Fi.

25. The antenna assembly of claim 22, wherein the second antenna is configured for use with global positioning systems, the antenna assembly further comprising a third antenna configured for use with cell phones and a fourth antenna configured for use with digital audio broadcasting.

* * * * *